US007997345B2

(12) United States Patent
Hannegan

(10) Patent No.: US 7,997,345 B2
(45) Date of Patent: Aug. 16, 2011

(54) UNIVERSAL MARINE DIVERTER CONVERTER

(75) Inventor: Don M. Hannegan, Fort Smith, AR (US)

(73) Assignee: Weatherford/Lamb, Inc., Houston, TX (US)

( * ) Notice: Subject to any disclaimer, the term of this patent is extended or adjusted under 35 U.S.C. 154(b) by 683 days.

(21) Appl. No.: 11/975,554

(22) Filed: Oct. 19, 2007

(65) Prior Publication Data

US 2009/0101351 A1 Apr. 23, 2009

(51) Int. Cl.
*E21B 29/12* (2006.01)

(52) U.S. Cl. ..... 166/345; 166/367; 166/84.3; 175/57

(58) Field of Classification Search ..... 166/367, 166/345, 347, 84.1, 84.3; 175/5, 57
See application file for complete search history.

(56) References Cited

U.S. PATENT DOCUMENTS

| | | | |
|---|---|---|---|
| 517,509 | A | 4/1894 | Williams |
| 1,157,644 | A | 10/1915 | London |
| 1,472,952 | A | 11/1923 | Anderson |
| 1,503,476 | A | 8/1924 | Childs et al. |
| 1,528,560 | A | 3/1925 | Myers et al. |
| 1,546,467 | A | 7/1925 | Bennett |
| 1,560,763 | A | 11/1925 | Collins |
| 1,700,894 | A | 2/1929 | Joyce et al. |
| 1,708,316 | A | 4/1929 | MacClatchie |
| 1,769,921 | A | 7/1930 | Hansen |
| 1,776,797 | A | 9/1930 | Sheldon |
| 1,813,402 | A | 7/1931 | Hewitt |
| 2,038,140 | A | 7/1931 | Stone |
| 1,831,956 | A | 11/1931 | Harrington |
| 1,836,470 | A | 12/1931 | Humason et al. |
| 1,902,906 | A | 3/1933 | Seamark |
| 1,942,366 | A | 1/1934 | Seamark |
| 2,036,537 | A | 4/1936 | Otis |
| 2,071,197 | A | 2/1937 | Burns et al. |
| 2,124,015 | A | 7/1938 | Stone et al. |
| 2,126,007 | A | 8/1938 | Guiberson et al. |
| 2,144,682 | A | 1/1939 | MacClatchie |
| 2,148,844 | A | 2/1939 | Stone et al. |
| 2,163,813 | A | 6/1939 | Stone et al. |
| 2,165,410 | A | 7/1939 | Penick et al. |
| 2,170,915 | A | 8/1939 | Schweitzer |
| 2,170,916 | A | 8/1939 | Schweitzer et al. |
| 2,175,648 | A | 10/1939 | Roach |
| 2,176,355 | A | 10/1939 | Otis |
| 2,185,822 | A | 1/1940 | Young |
| 2,199,735 | A | 5/1940 | Beckman |

(Continued)

FOREIGN PATENT DOCUMENTS

CA 2363132 A1 9/2000

(Continued)

OTHER PUBLICATIONS

U.S. 6,708,780, Nov. 15, 2001, Bourgoyne, et al., (withdrawn).

(Continued)

*Primary Examiner* — Thomas A Beach
(74) *Attorney, Agent, or Firm* — Strasburger & Price, LLP

(57) ABSTRACT

A universal marine diverter converter (UMDC) housing is clamped or latched to a rotating control device. The UMDC housing assembled with the RCD is inserted into a marine diverter above the water surface to allow conversion between conventional open and non-pressurized mud-return system drilling, and a closed and pressurized mud-return system used in managed pressure or underbalanced drilling.

28 Claims, 9 Drawing Sheets

U.S. PATENT DOCUMENTS

| | | | |
|---|---|---|---|
| 2,211,122 | A | 8/1940 | Howard |
| 2,222,082 | A | 11/1940 | Leman et al. |
| 2,233,041 | A | 2/1941 | Alley |
| 2,243,340 | A | 5/1941 | Hild |
| 2,243,439 | A | 5/1941 | Pranger et al. |
| 2,287,205 | A | 6/1942 | Stone |
| 2,303,090 | A | 11/1942 | Pranger et al. |
| 2,313,169 | A | 3/1943 | Penick et al. |
| 2,325,556 | A | 7/1943 | Taylor, Jr. et al. |
| 2,338,093 | A | 1/1944 | Caldwell |
| 2,480,955 | A | 9/1949 | Penick |
| 2,506,538 | A | 5/1950 | Bennett |
| 2,529,744 | A | 11/1950 | Schweitzer |
| 2,609,836 | A | 9/1952 | Knox |
| 2,628,852 | A | 2/1953 | Voytech |
| 2,646,999 | A | 7/1953 | Barske |
| 2,649,318 | A | 8/1953 | Skillman |
| 2,731,281 | A | 1/1956 | Knox |
| 2,746,781 | A | 5/1956 | Jones |
| 2,760,750 | A | 8/1956 | Schweitzer et al. |
| 2,760,795 | A | 8/1956 | Vertson |
| 2,764,999 | A | 10/1956 | Stanbury |
| 2,808,229 | A | 10/1957 | Bauer et al. |
| 2,808,230 | A | 10/1957 | McNeil et al. |
| 2,846,178 | A | 8/1958 | Minor |
| 2,846,247 | A | 8/1958 | Davis |
| 2,853,274 | A | 9/1958 | Collins |
| 2,862,735 | A | 12/1958 | Knox |
| 2,886,350 | A | 5/1959 | Horne |
| 2,904,357 | A | 9/1959 | Knox |
| 2,927,774 | A | 3/1960 | Ormsby |
| 2,929,610 | A | 3/1960 | Stratton |
| 2,962,096 | A | 11/1960 | Knox |
| 2,995,196 | A | 8/1961 | Gibson et al. |
| 3,023,012 | A | 2/1962 | Wilde |
| 3,029,083 | A | 4/1962 | Wilde |
| 3,032,125 | A | 5/1962 | Hiser et al. |
| 3,033,011 | A | 5/1962 | Garrett |
| 3,052,300 | A | 9/1962 | Hampton |
| 3,096,999 | A | 7/1963 | Ahlstone et al. |
| 3,100,015 | A | 8/1963 | Regan |
| 3,128,614 | A | 4/1964 | Auer |
| 3,134,613 | A | 5/1964 | Regan |
| 3,176,996 | A | 4/1965 | Barnett |
| 3,203,358 | A | 8/1965 | Regan et al. |
| 3,209,829 | A | 10/1965 | Haeber |
| 3,216,731 | A | 11/1965 | Dollison |
| 3,225,831 | A | 12/1965 | Knox |
| 3,259,198 | A | 7/1966 | Montgomery et al. |
| 3,268,233 | A | 8/1966 | Brown |
| 3,285,352 | A | 11/1966 | Hunter |
| 3,288,472 | A | 11/1966 | Watkins |
| 3,289,761 | A | 12/1966 | Smith et al. |
| 3,294,112 | A | 12/1966 | Watkins |
| 3,302,048 | A | 1/1967 | Gray |
| 3,313,345 | A | 4/1967 | Fischer |
| 3,313,358 | A | 4/1967 | Postlewaite et al. |
| 3,323,773 | A | 6/1967 | Walker |
| 3,333,870 | A | 8/1967 | Watkins |
| 3,347,567 | A | 10/1967 | Watkins |
| 3,360,048 | A | 12/1967 | Watkins |
| 3,372,761 | A | 3/1968 | van Gils |
| 3,387,851 | A | 6/1968 | Cugini |
| 3,397,928 | A | 8/1968 | Galle |
| 3,400,938 | A | 9/1968 | Williams |
| 3,401,600 | A | 9/1968 | Wood |
| 3,405,763 | A | 10/1968 | Pitts et al. |
| 3,421,580 | A | 1/1969 | Fowler et al. |
| 3,443,643 | A | 5/1969 | Jones |
| 3,445,126 | A | 5/1969 | Watkins |
| 3,452,815 | A | 7/1969 | Watkins |
| 3,472,518 | A | 10/1969 | Harlan |
| 3,476,195 | A | 11/1969 | Galle |
| 3,481,610 | A | 12/1969 | Slator et al. |
| 3,485,051 | A | 12/1969 | Watkins |
| 3,492,007 | A | 1/1970 | Jones |
| 3,493,043 | A | 2/1970 | Watkins |
| 3,503,460 | A | 3/1970 | Gadbois |
| 3,522,709 | A | 8/1970 | Vilain |
| 3,529,835 | A | 9/1970 | Lewis |
| 3,561,723 | A | 2/1971 | Cugini |
| 3,583,480 | A | 6/1971 | Regan |
| 3,587,734 | A | 6/1971 | Shaffer |
| 3,603,409 | A | 9/1971 | Watkins |
| 3,621,912 | A | 11/1971 | Wooddy, Jr. |
| 3,631,834 | A | 1/1972 | Gardner et al. |
| 3,638,721 | A | 2/1972 | Harrison |
| 3,638,742 | A | 2/1972 | Wallace |
| 3,653,350 | A | 4/1972 | Koons et al. |
| 3,661,409 | A | 5/1972 | Brown et al. |
| 3,664,376 | A | 5/1972 | Watkins |
| 3,667,721 | A | 6/1972 | Vujasinovic |
| 3,677,353 | A | 7/1972 | Baker |
| 3,724,862 | A | 4/1973 | Biffle |
| 3,741,296 | A | 6/1973 | Murman et al. |
| 3,779,313 | A | 12/1973 | Regan |
| 3,815,673 | A | 6/1974 | Bruce et al. |
| 3,827,511 | A | 8/1974 | Jones |
| 3,847,215 | A | 11/1974 | Herd |
| 3,868,832 | A | 3/1975 | Biffle |
| 3,872,717 | A | 3/1975 | Fox |
| 3,924,678 | A | 12/1975 | Ahlstone |
| 3,934,887 | A | 1/1976 | Biffle |
| 3,952,526 | A | 4/1976 | Watkins et al. |
| 3,955,622 | A | 5/1976 | Jones |
| 3,965,987 | A | 6/1976 | Biffle |
| 3,976,148 | A | 8/1976 | Maus et al. |
| 3,984,990 | A | 10/1976 | Jones |
| 3,992,889 | A | 11/1976 | Watkins et al. |
| 3,999,766 | A | 12/1976 | Barton |
| 4,037,890 | A | 7/1977 | Kurita et al. |
| 4,046,191 | A | 9/1977 | Neath |
| 4,052,703 | A | 10/1977 | Collins, Sr. et al. |
| 4,053,023 | A | 10/1977 | Herd et al. |
| 4,063,602 | A | 12/1977 | Howell et al. |
| 4,087,097 | A | 5/1978 | Bossens et al. |
| 4,091,881 | A | 5/1978 | Maus |
| 4,098,341 | A | 7/1978 | Lewis |
| 4,099,583 | A | 7/1978 | Maus |
| 4,109,712 | A | 8/1978 | Regan |
| 4,143,880 | A | 3/1979 | Bunting et al. |
| 4,143,881 | A | 3/1979 | Bunting |
| 4,149,603 | A | 4/1979 | Arnold |
| 4,154,448 | A | 5/1979 | Biffle |
| 4,157,186 | A | 6/1979 | Murray et al. |
| 4,183,562 | A | 1/1980 | Watkins et al. |
| 4,200,312 | A | 4/1980 | Watkins |
| 4,208,056 | A | 6/1980 | Biffle |
| 4,216,835 | A | 8/1980 | Nelson |
| 4,222,590 | A | 9/1980 | Regan |
| 4,249,600 | A | 2/1981 | Bailey |
| 4,281,724 | A | 8/1981 | Garrett |
| 4,282,939 | A | 8/1981 | Maus et al. |
| 4,285,406 | A | 8/1981 | Garrett et al. |
| 4,291,772 | A | 9/1981 | Beynet |
| 4,293,047 | A | 10/1981 | Young |
| 4,304,310 | A | 12/1981 | Garrett |
| 4,310,058 | A | 1/1982 | Bourgoyne, Jr. |
| 4,312,404 | A | 1/1982 | Morrow |
| 4,313,054 | A | 1/1982 | Martini |
| 4,326,584 | A | 4/1982 | Watkins |
| 4,335,791 | A | 6/1982 | Evans |
| 4,336,840 | A | 6/1982 | Bailey |
| 4,337,653 | A | 7/1982 | Chauffe |
| 4,345,769 | A | 8/1982 | Johnston |
| 4,349,204 | A | 9/1982 | Malone |
| 4,353,420 | A | 10/1982 | Miller |
| 4,355,784 | A | 10/1982 | Cain |
| 4,361,185 | A | 11/1982 | Biffle |
| 4,363,357 | A | 12/1982 | Hunter |
| 4,367,795 | A | 1/1983 | Biffle |
| 4,378,849 | A | 4/1983 | Wilks |
| 4,383,577 | A | 5/1983 | Pruitt |
| 4,384,724 | A | 5/1983 | Derman |
| 4,386,667 | A | 6/1983 | Millsapps, Jr. |
| 4,387,771 | A | 6/1983 | Jones |
| 4,398,599 | A | 8/1983 | Murray |

4,406,333 A 9/1983 Adams
4,407,375 A 10/1983 Nakamura
4,413,653 A 11/1983 Carter, Jr.
4,416,340 A 11/1983 Bailey
4,423,776 A 1/1984 Wagoner et al.
4,424,861 A 1/1984 Carter, Jr. et al.
4,427,072 A 1/1984 Lawson
4,439,068 A 3/1984 Pokladnik
4,440,232 A 4/1984 LeMoine
4,441,551 A 4/1984 Biffle
4,444,250 A 4/1984 Keithahn et al.
4,444,401 A * 4/1984 Roche et al. ..... 277/327
4,448,255 A 5/1984 Shaffer et al.
4,456,062 A * 6/1984 Roche et al. ..... 166/84.4
4,456,063 A 6/1984 Roche
4,457,489 A 7/1984 Gilmore
4,478,287 A 10/1984 Hynes et al.
4,480,703 A 11/1984 Garrett
4,484,753 A 11/1984 Kalsi
4,486,025 A 12/1984 Johnston
4,497,592 A 2/1985 Lawson
4,500,094 A 2/1985 Biffle
4,502,534 A 3/1985 Roche et al.
4,509,405 A 4/1985 Bates
4,524,832 A 6/1985 Roche et al.
4,526,243 A 7/1985 Young
4,527,632 A 7/1985 Chaudot
4,529,210 A 7/1985 Biffle
4,531,580 A 7/1985 Jones
4,531,591 A 7/1985 Johnston
4,531,593 A 7/1985 Elliott et al.
4,531,951 A 7/1985 Burt et al.
4,533,003 A 8/1985 Bailey et al.
4,540,053 A 9/1985 Baugh et al.
4,546,828 A 10/1985 Roche
4,553,591 A 11/1985 Mitchell
D282,073 S 1/1986 Bearden et al.
4,566,494 A 1/1986 Roche
4,575,426 A 3/1986 Littlejohn et al.
4,595,343 A 6/1986 Thompson et al.
4,597,447 A 7/1986 Roche et al.
4,597,448 A 7/1986 Baugh
4,610,319 A 9/1986 Kalsi
4,611,661 A 9/1986 Hed et al.
4,615,544 A 10/1986 Baugh
4,618,314 A 10/1986 Hailey
4,621,655 A 11/1986 Roche
4,623,020 A 11/1986 Nichols
4,626,135 A 12/1986 Roche
4,630,680 A 12/1986 Elkins
4,632,188 A 12/1986 Schuh et al.
4,646,826 A 3/1987 Bailey et al.
4,646,844 A 3/1987 Roche et al.
4,651,830 A 3/1987 Crotwell
4,660,863 A 4/1987 Bailey et al.
4,688,633 A 8/1987 Barkley
4,690,220 A 9/1987 Braddick
4,697,484 A 10/1987 Klee et al.
4,709,900 A 12/1987 Dyhr
4,712,620 A 12/1987 Lim et al.
4,719,937 A 1/1988 Roche et al.
4,722,615 A 2/1988 Bailey et al.
4,727,942 A 3/1988 Galle et al.
4,736,799 A 4/1988 Ahlstone
4,745,970 A 5/1988 Bearden et al.
4,749,035 A 6/1988 Cassity
4,754,820 A 7/1988 Watts et al.
4,757,584 A 7/1988 Pav et al.
4,759,413 A 7/1988 Bailey et al.
4,765,404 A 8/1988 Bailey et al.
4,783,084 A 11/1988 Biffle
4,807,705 A 2/1989 Henderson et al.
4,813,495 A 3/1989 Leach
4,817,724 A 4/1989 Funderburg, Jr. et al.
4,822,212 A 4/1989 Hall et al.
4,825,938 A 5/1989 Davis
4,828,024 A 5/1989 Roche
4,832,126 A 5/1989 Roche
4,836,289 A 6/1989 Young
4,865,137 A 9/1989 Bailey et al.
4,882,830 A 11/1989 Carstensen
4,909,327 A 3/1990 Roche
4,949,796 A 8/1990 Williams
4,955,436 A 9/1990 Johnston
4,955,949 A 9/1990 Bailey et al.
4,962,819 A 10/1990 Bailey et al.
4,971,148 A 11/1990 Roche et al.
4,984,636 A 1/1991 Bailey et al.
4,995,464 A 2/1991 Watkins et al.
5,009,265 A 4/1991 Bailey et al.
5,022,472 A 6/1991 Bailey et al.
5,028,056 A 7/1991 Bemis et al.
5,035,292 A 7/1991 Bailey et al.
5,040,600 A 8/1991 Bailey et al.
5,048,621 A 9/1991 Bailey et al.
5,062,450 A 11/1991 Bailey et al.
5,062,479 A 11/1991 Bailey et al.
5,072,795 A 12/1991 Delgado et al.
5,076,364 A 12/1991 Hale et al.
5,082,020 A 1/1992 Bailey et al.
5,085,277 A 2/1992 Hopper
5,101,897 A 4/1992 Leismer et al.
5,137,084 A 8/1992 Gonzales et al.
5,147,559 A 9/1992 Brophey et al.
5,154,231 A 10/1992 Bailey et al.
5,163,514 A 11/1992 Jennings
5,165,480 A 11/1992 Wagoner et al.
5,178,215 A 1/1993 Yenulis et al.
5,182,979 A 2/1993 Morgan
5,184,686 A 2/1993 Gonzalez
5,195,754 A 3/1993 Dietle
5,213,158 A 5/1993 Bailey et al.
5,215,151 A 6/1993 Smith et al.
5,224,557 A 7/1993 Yenulis et al.
5,230,520 A 7/1993 Dietle et al.
5,243,187 A 9/1993 Hettlage
5,251,869 A 10/1993 Mason
5,255,745 A 10/1993 Czyrek
5,277,249 A 1/1994 Yenulis et al.
5,279,365 A 1/1994 Yenulis et al.
5,305,839 A 4/1994 Kalsi et al.
5,320,325 A 6/1994 Young et al.
5,322,137 A 6/1994 Gonzales
5,325,925 A 7/1994 Smith et al.
5,348,107 A 9/1994 Bailey et al.
5,375,476 A 12/1994 Gray
5,427,179 A 6/1995 Bailey et al.
5,431,220 A 7/1995 Lennon et al.
5,443,129 A 8/1995 Bailey et al.
5,495,872 A 3/1996 Gallagher et al.
5,529,093 A 6/1996 Gallagher et al.
5,588,491 A 12/1996 Brugman et al.
5,607,019 A 3/1997 Kent
5,647,444 A 7/1997 Williams
5,657,820 A 8/1997 Bailey et al.
5,662,171 A 9/1997 Brugman et al.
5,662,181 A 9/1997 Williams et al.
5,671,812 A 9/1997 Bridges
5,678,829 A 10/1997 Kalsi et al.
5,735,502 A 4/1998 Levett et al.
5,738,358 A 4/1998 Kalsi et al.
5,755,372 A 5/1998 Cimbura
5,823,541 A 10/1998 Dietle et al.
5,829,531 A 11/1998 Hebert et al.
5,848,643 A 12/1998 Carbaugh et al.
5,873,576 A 2/1999 Dietle et al.
5,878,818 A 3/1999 Hebert et al.
5,901,964 A 5/1999 Williams et al.
5,944,111 A 8/1999 Bridges
6,007,105 A 12/1999 Dietle et al.
6,016,880 A 1/2000 Hall et al.
6,017,168 A 1/2000 Fraser, Jr. et al.
6,036,192 A 3/2000 Dietle et al.
6,076,606 A 6/2000 Bailey et al.
6,102,123 A 8/2000 Bailey et al.
6,102,673 A 8/2000 Mott et al.
6,109,348 A 8/2000 Caraway
6,109,618 A 8/2000 Dietle 6,112,810 A 9/2000 Bailey et al.
6,120,036 A 9/2000 Kalsi et al.
6,129,152 A 10/2000 Hosie et al.
6,138,774 A 10/2000 Bourgoyne, Jr. et al.
6,170,576 B1 1/2001 Brunnert et al.
6,202,745 B1 3/2001 Reimert et al.
6,209,663 B1 4/2001 Hosie
6,213,228 B1 4/2001 Saxman
6,227,547 B1 5/2001 Dietle et al.
6,230,824 B1 5/2001 Peterman et al.
6,244,359 B1 6/2001 Bridges et al.
6,263,982 B1 7/2001 Hannegan et al.
6,273,193 B1 8/2001 Hermann et al.
6,315,302 B1 11/2001 Conroy et al.
6,315,813 B1 11/2001 Morgan et al.
6,325,159 B1 12/2001 Peterman et al.
6,334,619 B1 1/2002 Dietle et al.
6,354,385 B1 3/2002 Ford et al.
6,361,830 B1 3/2002 Schenk
6,375,895 B1 4/2002 Daemen
6,382,634 B1 5/2002 Dietle et al.
6,386,291 B1 5/2002 Short et al.
6,413,297 B1 7/2002 Morgan et al.
6,450,262 B1 9/2002 Regan
6,454,007 B1 9/2002 Bailey
6,457,529 B2 10/2002 Calder et al.
6,470,975 B1 10/2002 Bourgoyne et al.
6,478,303 B1 11/2002 Radcliffe
6,494,462 B2 12/2002 Dietle
6,504,982 B1 1/2003 Greer, IV
6,505,691 B2 1/2003 Judge et al.
6,520,253 B2 2/2003 Calder
6,536,520 B1 3/2003 Snider et al.
6,536,525 B1 3/2003 Haugen et al.
6,547,002 B1 4/2003 Bailey et al.
6,554,016 B2 4/2003 Kinder
6,561,520 B2 5/2003 Kalsi et al.
6,581,681 B1 6/2003 Zimmerman et al.
6,607,042 B2 8/2003 Hoyer et al.
RE38,249 E 9/2003 Tasson et al.
6,655,460 B2 12/2003 Bailey et al.
6,685,194 B2 2/2004 Dietle et al.
6,702,012 B2 3/2004 Bailey et al.
6,708,762 B2 3/2004 Haugen et al.
6,720,764 B2 4/2004 Relton et al.
6,725,951 B2 4/2004 Looper
6,732,804 B2 5/2004 Hosie et al.
6,749,172 B2 6/2004 Kinder
6,767,016 B2 7/2004 Gobeli et al.
6,843,313 B2 1/2005 Hult
6,851,476 B2 2/2005 Gray et al.
6,877,565 B2 4/2005 Edvardsen
6,886,631 B2 5/2005 Wilson et al.
6,896,048 B2 5/2005 Mason et al.
6,896,076 B2 5/2005 Nelson et al.
6,913,092 B2 7/2005 Bourgoyne et al.
6,945,330 B2 9/2005 Wilson et al.
7,004,444 B2 2/2006 Kinder
7,007,913 B2 3/2006 Kinder
7,011,167 B2 3/2006 Ebner et al.
7,025,130 B2 4/2006 Bailey et al.
7,028,777 B2 4/2006 Wade et al.
7,032,691 B2 4/2006 Humphreys
7,040,394 B2 5/2006 Bailey et al.
7,044,237 B2 5/2006 Leuchtenberg
7,073,580 B2 7/2006 Wilson et al.
7,077,212 B2 7/2006 Roesner et al.
7,080,685 B2 7/2006 Bailey et al.
7,086,481 B2 8/2006 Hosie et al.
7,152,680 B2 12/2006 Wilson et al.
7,159,669 B2 1/2007 Bourgoyne et al.
7,165,610 B2 1/2007 Hopper
7,174,956 B2 2/2007 Williams et al.
7,178,600 B2 2/2007 Luke et al.
7,191,840 B2 3/2007 Pietras et al.
7,198,098 B2 4/2007 Williams
7,204,315 B2 4/2007 Pia
7,219,729 B2 5/2007 Bostick et al.
7,237,618 B2 7/2007 Williams
7,237,623 B2 7/2007 Hannegan
7,240,727 B2 7/2007 Williams
7,243,958 B2 7/2007 Williams
7,255,173 B2 8/2007 Hosie et al.
7,258,171 B2 8/2007 Bourgoyne et al.
7,278,494 B2 10/2007 Williams
7,278,496 B2 10/2007 Leuchtenberg
7,296,628 B2 11/2007 Robichaux et al.
7,308,954 B2 12/2007 Martin-Marshall
7,325,610 B2 2/2008 Giroux et al.
7,334,633 B2 2/2008 Williams et al.
7,347,261 B2 3/2008 Markel et al.
7,350,590 B2 4/2008 Hosie et al.
7,363,860 B2 4/2008 Wilson et al.
7,367,411 B2 5/2008 Leuchtenberg
7,380,590 B2 6/2008 Hughes
7,380,591 B2 6/2008 Williams
7,380,610 B2 6/2008 Williams
7,383,876 B2 6/2008 Gray et al.
7,389,183 B2 6/2008 Gray
7,392,860 B2 7/2008 Johnston
7,413,018 B2 8/2008 Hosie et al.
7,416,021 B2 8/2008 Williams
7,416,226 B2 8/2008 Williams
7,448,454 B2 11/2008 Bourgoyne et al.
7,451,809 B2 11/2008 Noske et al.
7,475,732 B2 1/2009 Hosie et al.
7,487,837 B2 2/2009 Bailey et al.
7,513,300 B2 4/2009 Pietras et al.
7,559,359 B2 7/2009 Williams
7,635,034 B2 12/2009 Williams
7,654,325 B2 2/2010 Giroux et al.
7,669,649 B2 3/2010 Williams
7,699,109 B2 * 4/2010 May et al. ..... 166/367
2001/0040052 A1 * 11/2001 Bourgoyne et al. ..... 175/7
2003/0106712 A1 * 6/2003 Bourgoyne et al. ..... 175/5
2003/0164276 A1 9/2003 Snider et al.
2003/0173073 A1 9/2003 Snider et al.
2004/0017190 A1 1/2004 Graham et al.
2004/0178001 A1 * 9/2004 Bourgoyne et al. ..... 175/7
2005/0028972 A1 2/2005 Wilson et al.
2005/0151107 A1 7/2005 Shu
2005/0161228 A1 7/2005 Cook et al.
2005/0211429 A1 9/2005 Gray et al.
2005/0241833 A1 11/2005 Bailey et al.
2006/0037782 A1 2/2006 Martin-Marshall
2006/0102387 A1 * 5/2006 Bourgoyne et al. ..... 175/5
2006/0108119 A1 5/2006 Bailey et al.
2006/0144622 A1 7/2006 Bailey et al.
2006/0157282 A1 7/2006 Tilton et al.
2006/0191716 A1 8/2006 Humphreys
2007/0051512 A1 3/2007 Markel et al.
2007/0095540 A1 5/2007 Kozicz et al.
2007/0163784 A1 7/2007 Bailey et al.
2008/0035377 A1 2/2008 Sullivan et al.
2008/0041149 A1 2/2008 Leuchtenberg
2008/0047449 A1 2/2008 Wilson et al.
2008/0059073 A1 3/2008 Giroux et al.
2008/0060846 A1 3/2008 Belcher et al.
2008/0105462 A1 5/2008 May et al.
2008/0110637 A1 5/2008 Snider et al.
2008/0169107 A1 7/2008 Redlinger et al.
2008/0210471 A1 9/2008 Bailey et al.
2008/0236819 A1 10/2008 Foster et al.
2008/0245531 A1 10/2008 Noske et al.
2008/0296016 A1 12/2008 Hughes et al.
2009/0025930 A1 1/2009 Iblings et al.
2009/0057012 A1 3/2009 Williams
2009/0057020 A1 3/2009 Williams
2009/0057021 A1 3/2009 Williams
2009/0057022 A1 3/2009 Williams
2009/0057024 A1 3/2009 Williams
2009/0057025 A1 3/2009 Williams
2009/0057027 A1 3/2009 Williams
2009/0057029 A1 3/2009 Williams
2009/0101351 A1 4/2009 Hannegan et al.
2009/0101411 A1 4/2009 Hannegan et al.
2009/0139724 A1 6/2009 Gray et al.
2009/0152006 A1 6/2009 Leduc et al.

| | | | |
|---|---|---|---|
| 2009/0166046 | A1 | 7/2009 | Edvardsen et al. |
| 2009/0200747 | A1 | 8/2009 | Williams |
| 2009/0211239 | A1 | 8/2009 | Askeland |
| 2009/0236144 | A1 | 9/2009 | Todd et al. |
| 2009/0301723 | A1 | 12/2009 | Gray |
| 2010/0008190 | A1 | 1/2010 | Gray et al. |

FOREIGN PATENT DOCUMENTS

| | | | |
|---|---|---|---|
| CA | 2447196 | A1 | 4/2004 |
| EP | 0290250 | A2 | 11/1988 |
| EP | 0290250 | A3 | 11/1988 |
| EP | 0267140 | B1 | 3/1993 |
| EP | 1375817 | A1 | 1/2004 |
| EP | 1519003 | A1 | 3/2005 |
| EP | 1659260 | A2 | 5/2006 |
| GB | 2019921 | A | 11/1979 |
| GB | 2067235 | A | 7/1981 |
| GB | 2394741 | A | 5/2004 |
| GB | 2449010 | A | 8/2007 |
| WO | WO 99/45228 | A1 | 9/1999 |
| WO | WO 99/50524 | A2 | 10/1999 |
| WO | WO 99/50524 | A3 | 10/1999 |
| WO | WO 99/51852 | A1 | 10/1999 |
| WO | WO 00/52299 | A1 | 9/2000 |
| WO | WO 00/52300 | A1 | 9/2000 |
| WO | WO 02/50398 | A1 | 6/2002 |
| WO | WO 03/071091 | A1 | 8/2003 |
| WO | WO 2006/088379 | A1 | 8/2006 |
| WO | WO 2007/092956 | A2 | 8/2007 |
| WO | WO 2008/133523 | A1 | 11/2008 |
| WO | WO 2008/156376 | A1 | 12/2008 |
| WO | WO 2009/017418 | A1 | 2/2009 |

OTHER PUBLICATIONS

Cameron, The Modular T BOP Stack System, Brochure SD-100076, Apr. 1985 © 1985 Cameron Iron Works, Inc. (5 pages).

Cameron, Cameron HC Collet Connector, Brochure WR4701, Mar. 1996 © 1996 Cooper Cameron Corporation, Cameron Division (12 pages).

Gault, Allen, Riserless drilling: circumventing the size/cost cycle in deepwater—Conoco, Hydril project seek enabling technologies to drill in deepest water depths economically, Offshore Drilling Technology, May 1996, pp. 49, 50, 52, 53, 54 & 55 (6 pages).

Williams Tool Company, Inc. website home page, Under Construction Williams Rotating Control Heads (2 pages); Seal-Ability for the pressures of drilling (2 pages); Williams Model 7000 Series Rotating Control Heads (1 page); Williams Model 7000 & 7100 Series Rotating Control Heads (2 pages); Williams Model IP1000 Rotating Control Head (2 pages); Williams Conventional Models 8000 & 9000 (2 pages); Applications—Where using a Williams rotating control head while drilling is a plus (1 page); Williams higher pressure rotating control head systems are Ideally Suited for New Technology Flow Drilling and Closed Loop Underbalanced Drilling (UBD) Vertical and Horizontal (2 pages); and How to Contact us (2 pages).

Furlow, William, Shallow flow diverter JIP spurred by deepwater washouts, Offshore—World Trends and Technology for Offshore Oil and Gas Operations, Mar. 1998, cover page and pp. 2 & 90 (3 pages).

Williams Tool Company, Inc., Rotating Control Heads and Strippers for Air, Gas, Mud, and Geothermal Drilling Worldwide—Sales Rental Service, © 1988 Williams Tool Co., Inc. (19 pages).

Williams Tool Company, Inc., Rotating Control Heads and Strippers for Air, Gas, Mud, Geothermal and Horizontal Drilling, Catalog #2002, © 1991 Williams Tool Co., Inc. (19 pages).

Fig. 14 Floating Piston Drilling Choke Design, printed May 1997 (1 page).

Stone, Charles R. "Rick" et al., Blowout Preventer Testing for Underbalanced Drilling, Sep. 1997, Signa Engineering Corp., Houston, Texas (24 pages).

Williams Tool Company, Inc., Instructions—Assemble & Disassemble Model 9000 Bearing Assembly (cover page and 27 numbered pages).

Williams Tool Company, Inc., Rotating Control Heads—Making Drilling Safer While Reducing Costs Since 1968, © 1989 Williams Tool Co., Inc. (4 pages).

Williams Tool Company, Inc., International—Model 7000 Rotating Control Head, © 1991 Williams Tool Co., Inc. (4 pages).

Williams Tool Company, Inc., Williams Rotating Control Heads—Reduce Costs—Increase Safety—Reduce Environmental Impact, © 1995 Williams Tool Co., Inc. (4 pages).

Williams Tool Company, Inc., Sales-Rental-Service—Williams Rotating Control Heads and Strippers for Air, Gas, Mud, and Geothermal Drilling, © 1982 Williams Tool Co., Inc. (7 pages).

Williams Tool Company, Inc., Rotating Control Heads and Strippers for Air, Gas, Mud and Geothermal Drilling, Catalog #2001, © 1991 Williams Tool Co., Inc. (19 pages).

Hannegan, Don, Williams Tool Co., Inc., Communicating—The When? and Why? of Rotating Control Head Usage, The Brief Jan. 1996 issue, The Brief's Guest Columnists, Dec. 13, 1995 Article Index No. 20, pp. 26-27, © 1996 Murphy Publishing, Inc. (2 pages).

Bourgoyne, Jr., Adam T., Rotating control head applications increasing, Oil & Gas Journal, Technology, Reprinted from the Oct. 9, 1995 edition of Oil & Gas Journal, © 1995 PennWell Publishing Company (4 pages).

Grant Oil Tool Company, Rotating Drilling Head for Air, Gas or Mud Drilling, 1966-1967 Composite Catalog, p. 2041 (1 page).

Grant Oil Tool Company, Rotating Drilling Head Models 7068, 7368, 8068 (Patented)—Equally Effective with Air, Gas, or Mud Circulation Media, 1976-1977 Composite Catalog, pp. 2691-2693 (3 pages).

Bourgoyne, Darryl A. et al., A Subsea Rotating Control Head for Riserless Drilling Applications, 1998 International Association of Drilling Contractors International Deep Water Well Control Conference held in Houston, Texas, Aug. 26-27, 1998, pp. D-86 to D-99 © 1998 (14 pages).

Hannegan, Don, Applications widening for rotating control heads, Drilling Contractor, Jul. 1996, cover page and pp. 5, 17, & 19, vol. 52, No. 4, Drilling Contractor Publications Inc., Houston, Texas (4 pages).

Hughes Tool Company, Hughes Offshore 1986-87 Subsea Systems and Equipment, Hughes Drilling Equipment Composite Catalog, pp. 2986-3004 (19 pages).

Williams Tool Company, Inc., Technical Specifications Model—The Model 7100 (3 pages).

Williams Tool Company, Inc. website, Underbalanced Drilling (UBD)—The Attraction of UBD (2 pages).

Williams Tool Company, Inc. website, Applications—Where using a Williams rotating control head while drilling is a plus (2 pages).

Williams Tool Company, Inc. website, Model 7100 (3 pages).

Hughes Tool Company, Hughes Offshore 1982/1983 Regan Products, Hughes Offshore Composite Catalog, Regan Products, cover page 4308-20, 4308-27 thru 4308-43, and end sheet, (see p. 4308-36 Type KFDR Diverter) © 1982 Hughes Offshore (20 pages).

Coflexip International, Brochure, p. 1: Coflexip Sales Offices, p. 2: The Flexible Steel Pipe for Drilling and Service Applications, p. 3: New 5" I.D.—General Drilling Flexible, p. 4: Applications, and p. 5-Illustration (5 pages).

Baker, Ron, A Primer of Oilwell Drilling, 4$^{th}$ Edition, 3 cover pages and pp. 42-49, Petroleum Extension Service of The University of Texas at Austin, Austin, Texas © 1979 The University of Texas at Austin (11 pages).

Dutch Enterprises Inc., Lock down Lubricator System—"Safety with Savings", pp. D-3 thru D-18 (see above U.S. Patent No. 4,836,289 referenced on pp. D-6 & D-7) (16 pages).

Hydril Company website, Hydril GL® Annual Blowout Preventers (Patented), printed Aug. 28, 1998, pp. D-20 & D-21, corresponding website http://www.hydril.com/ns/Pbro/bop8.htm, (see Roche patents above) (2 pages).

Hydril Company website, About Pressure Control Products, printed Aug. 28, 1998, pp. D-29 thru D-47, corresponding website http://www.hydril.com/ns/Pbro/bop8.htm, (the GH Gas Handler Series Product is listed), © 1996 Hydril Company (19 pages).

NL Industries, Inc., Shaffer Type 79 Rotating Blowout Preventers—NL Rig Equipment/NL Industries, Inc., pp. D-49 thru D-54, Brochure NLS 4849-580 (6 pages).

Shaffer®, A Varco® Company, Shaffer® Pressure Control, Spherical® Blowout Preventers, Shaffer's NXT BOP, Other Products, cover page and pp. 1562-1568 (8 pages).

Leach, Colin P. et al., Avoiding Explosive Unloading of Gas in a Deep Water Riser when SOBM is in Use, 1998 (describes an application for the Hydril GH 21/2000 Gas Handler shown in Figure 1) (9 pages).

Lopes, Clovis A. et al., Feasibility Study of a Dual Density Mud System for Deepwater Drilling Operations, 1997 Offshore Technology Conference held in Houston, Texas, May 5-8, 1997, Paper No. OTC 8465; pp. 257-266 © 1997 Offshore Technology Conference (10 pages).
Offshore Drilling with Light-weight Fluids, Joint Industry Project Presentation, Apr. 1998, pp. C-3 thru C-11 (9 pages).
Nakagawa, Edson Y. et al., Application of Aerated-Fluid Drilling in Deepwater, 1999 SPE/IADC Drilling Conference held in Amsterdam, Holland, Mar. 9-11, 1999, Paper SPE/IADC 52787, Presented by Don Hannegan, P.E., SPE © 1999 SPE/IADC Drilling Conference (5 pages).
Inter-Tech Drilling Solutions Ltd., Inter-Tech Drilling Solutions Ltd. 's RBOP™ means Safety and Experience for Underbalanced Drilling, Inter-Tech Drilling Solutions Ltd./Big D Rentals & Sales (1981) Ltd. (2 pages).
Shaffer®, A Varco® Company, Pressure Control While Drilling, © Varco Shaffer, Inc. (2 pages).
Shaffer®, A Varco® Company, Field Exposure (As of Aug. 1998) (1 page).
Rotating Spherical BOP (1 page).
Nakagawa, Edson Yoshihito et al., JIP's Work Brightens Outlook for UBD in Deep Waters, The American Oil & Gas Reporter®, Apr. 1999, cover page and pp. 53, 56, 58-61 & 63 (8 pages).
Seal-Tech—Division Folsom Metal Products, 1500 PSI Rotating Blowout Preventer, (3 pages).
Techcorp Industries International, Inc., RPM System 3000™ Rotating Blowout Preventer—"Setting a new standard in Well Control," (4 pages).
Williams Tool Company, Inc., RiserCap™ Materials Presented at the 1999 LSU/MMS/IADC Well Control Workshop, Mar. 24-25, 1999, Session 2, Presentation 12 © 1999 Williams Tool Company, Inc. (14 pages).
Smith, John Rogers, The 1999 LSU/MMS Well Control Workshop: An overview, World Oil® Jun. 1999, cover page and pp. 4, 41-42, & 44-45, Gulf Publishing Company, Houston, Texas (6 pages).
Nessa, Dag Oluf et al., Offshore underbalanced drilling system could revive field developments, World Oil®, Oct. 1997, vol. 218, No. 10, cover page and pp. 3, 83-84, 86 & 88, Gulf Publishing Company, Houston, Texas, © 1997 Gulf Publishing Company (6 pages).
Nessa, Dag Oluf et al., Offshore underbalanced drilling system could revive field developments, World Oil®, Jul. 1997, vol. 218, No. 7, cover page and pp. 3, 61-64, & 66, Gulf Publishing Company, Houston, Texas, © 1997 Gulf Publishing Company (7 pages).
PCT International Search Report, International Application No. PCT/US99/06695, completion date May 27, 1999, mailing date Jun. 14, 1999 (4 pages).
PCT International Search Report, International Application No. PCT/GB00/00731, completion date Jun. 16, 2000, mailing date Jun. 27, 2000 (3 pages).
National Academy of Sciences—National Research Council, Design of a Deep Ocean Drilling Ship, cover page and pp. 114-121(in above U.S. Patent No. 6,230,824 B1) (9 pages).
Cress, L.A. et al., History and Development of a Rotating Preventer, 1992 IADC/SPE Drilling Conference held in New Orleans, Louisiana, Feb. 18-21, 1992, Paper IADC/SPE 23931, pp. 757-773 (17 pages).
Rehm, Bill, Practical Underbalanced Drilling and Workover, 2002, cover page, title page, copyright page, and pp. 6-6, 11-2, 11-3, G-9, and G-10, Petroleum Extension Service—The University of Texas at Austin, © 2002 The University of Texas at Austin (8 pages).
Williams Tool Company Inc., RISERCAP™: Rotating Control Head System for Floating Drilling Rig Applications, © 1999 Williams Tool Company, Inc. (4 pages).
Lage, Antonio et al., Drilling With Aerated Drilling Fluid From a Floating Unit Part 2: Drilling the Well, 2001 SPE Annual Technical Conference and Exhibition held in New Orleans, Louisiana, Sep. 30, 2001 to Oct. 3, 2001, Paper SPE 71361, © 2001 Society of Petroleum Engineers, Inc. (11 pages).
Santos, Helio et al., Drilling and Aerated Fluid from a Floating Unit. Part 1: Planning, Equipment, Tests, and Rig Modifications, 2001 SPE/IADC Drilling Conference held in Amsterdam, The Netherlands, Feb. 27, 2001 to Mar. 1, 2001, Paper SPE/IADC 67748, © 2001 SPE/IADC Drilling Conference (8 pages).
Nakagawa, E. Y. et al., Planning of Deepwater Drilling Operations with Aerated Fluids, 1999 SPE Asia Pacific Oil and Gas Conference and Exhibition held in Jakarta, Indonesia, Apr. 20-22, 1999, Paper SPE 54283, (© 1999 Society of Petroleum Engineers (7 pages).
Nakagawa, E. Y. et al., Implementing the Light-Weight Fluids Drilling Technology in Deepwater Scenarios, 1999 LSU/MMS Well Control Workshop Mar. 24-25, 1999 (12 pages).
Stewart & Stevenson website, Press Releases: Stewart & Stevenson introduces First Dual Gradient Riser, Aug. 31, 2000, printed Oct. 7, 2002, corresponding website http://www.ssss.com/ssss/20000831.asp (2 pages).
Williams Tool Company Inc., Williams Tool Company Introduces the . . . Virtual Riser™, © 1998 Williams Tool Company, Inc. (4 pages).
The University of Texas at Austin website, Petroleum Extension Service, PETEX Publications, printed Nov. 14, 2003, corresponding website http://www.utexas.edu/cee/petex/pubs/drilling.html,(last modified Dec. 6, 2002) (12 pages).
SPE International, BG in the Caspian region, SPE Review, Magazine of the Aberdeen and London Sections of the Society of Petroleum Engineers, May 2003, Issue 164 (3 pages).
Impact Fluid Solutions, Field Cases as of Mar. 3, 2003, printed Sep. 5, 2003, corresponding website http://www.impact-os.com/fluid_solutions/Field_Cases.htm (6 pages).
Maurer Technology Inc, Determine in the Safe Application of Underbalanced Drilling Technologies in Marine Environments—Technical Proposal, Jun. 17, 2002, Proposal TP02-10 JIP (13 pages).
Colbert, John W., John W. Colbert, P.E. Vice President Engineering Biographical Data, Signa Engineering Corp. (2 pages).
Parker Drilling website, Technical Training Courses, printed Sep. 5, 2003, corresponding website http://www.parkerdrilling.com/news/tech.html (5 pages).
Drilling equipment: Improvements from data recording to slim hole, Drilling Contractor, Mar./Apr. 2000, pp. 30-32, Drilling Contractor Publications, Inc., Houston, Texas (3 pages).
Drilling conference promises to be informative, Drilling Contractor, Jan./Feb. 2002, p. 10 (1 page).
Ogci, Inc. website, Underbalanced and Air Drilling, printed Sep. 5, 2003, corresponding website http://www.ogci.com/course info.asp?counseID=410 (2 pages).
Society of Professional Engineers website, 2003 SPE Calendar, printed Sep. 5, 2003, cache of corresponding website http://www.spe.org/spe/cda/views/events/eventMaster/0,1470,1648_2194_632303.00.html, © 2001 Society of Professional Engineers (2 pages).
Schlumberger Limited website, Oilfield Glossary—reverse-circulating valve, corresponding website http://www.glossary.oilfield.slb.com/Display.cfm?Term=reverse-circulating%20valve, © 2003 Schlumberger Limited (1 page).
Murphy, Ross D. et al., A drilling contractor's view of underbalanced drilling, WorldOil® Magazine, May 2002, vol. 223, No. 5, Feature Article (9 pages).
Weatherford, Weatherford UnderBalanced Services—General Underbalance Presentation to the DTI, © 2002 Weatherford (71 pages).
Rach, Nina M., Underbalanced near-balanced drilling are possible offshore, Oil & Gas Journal, Dec. 1, 2003, pp. 39-44 (6 pages).
Forrest, Neil et al., Subsea Equipment for Deep Water Drilling Using Dual Gradient Mud System, SPE/IADC Drilling Conference held in Amsterdam, The Netherlands, Feb. 27, 2001 to Mar. 1, 2001, Paper SPE/IADC 67707, © 2001 SPE/IADC Drilling Conference (8 pages).
Hannegan, D.M. et al., Deepwater Drilling with Lightweight Fluids—Essential Equipment Required, SPE/IADC Drilling Conference held in Amsterdam, The Netherlands, Feb. 27, 2001 to Mar. 1, 2001, Paper SPE/IADC 67708, © 2001 SPE/IADC Drilling Conference (6 pages).
Hannegan, Don M., Underbalanced Operations Continue Offshore Movement, SPE/IcoTA Coiled Tubing Roundtable held in Houston, Texas, Mar. 7-8, 2001, Paper SPE 68491, © 2001 Society of Petroleum Engineers, Inc. (3 pages).
Hannegan, D., Underbalanced Drilling—Perceptions and Realities of Today's Technology in Offshore Applications, IADC/SPE Drilling Conference held in Dallas, Texas, Feb. 26-28, 2002, Paper IADC/SPE 74448, © 2002 IADC/SPE Drilling Conference (9 pages).
Hannegan, Don M. et al., Well Control Considerations—Offshore Applications of Underbalanced Drilling Technology, SPE/IADC Drilling Conference held in Amsterdam, The Netherlands, Feb. 19-21, 2003, Paper SPE/IADC 79854, ©2003 SPE/IADC Drilling Conference (14 pages).
Bybee, Karen, Offshore Applications of Underbalanced—Drilling Technology, Journal of Petroleum Technology, Jan. 2004, cover page and pp. 51-52 (3 pages).
Bourgoyne, Darryl A. et al., A Subsea Rotating Control Head for Riserless Drilling Applications, 1998 IADC International Deep Water Well Control Conference held in Houston, Texas, Aug. 26-27, 1998 (see document T)© 1998 (14 pages).
Lage, Antonio et al., Drilling With Aerated Drilling Fluid From a Floating Unit Part 2: Drilling the Well, 2001 SPE Annual Technical Conference and Exhibition held in New Orleans, Louisiana, Sep. 30, 2001 to Oct. 3, 2001, Paper SPE 71361, (see document BBB) © Society of Professional Engineers Inc. (11 pages).
Furlow, William, Shell's seafloor pump, solids removal key to ultra-deep, dual-gradient drilling—Skid ready for commercialization, Offshore Magazine, World Trends and Technology for Offshore Oil and Gas Operations, Jun. 2001, cover page, and pp. 4, 54, 2 unnumbered pages, & 106, International Edition, vol. 61, No. 6, PennWell, © 2001 PennWell (6 pages).
Rowden, Michael V., Advances in riserless drilling pushing the deepwater surface string envelope—Alternative to seawater, CaCl2 sweeps, Offshore Magazine, World Trends and Technology for Offshore Oil and Gas Operations, Jun. 2001, cover page, p. 4, 56, 58, and 106, International Edition, vol. 61, No. 6, PennWell, © 2001 PennWell (5 pages).
Boye, John, Multi Purpose Intervention Vessel Presentation, M.O.S.T. Multi Operational Service Tankers, Jan. 2004, © 2003 Weatherford (43 pages).
GB Search Report, International Application No. GB 0324939.8, Jan. 21, 2004 (1 page).
Terwogt, Jan; Maekiaho, Leo; Si-Boon, Wee (Shell Malaysia Exploration and Production); Jenkins, James; Gedge, Ben (Weatherford); "Pressured Mud Cap Drilling—Advanced Well Control for Subsea Wells"; Petromin Subsea Asia Conference, Sep. 20-21, 2004, Kuala Lumpur, Malaysia (8 pages).
PCT International Search Report, International Application No. PCT/EP2004/052167, date of completion Nov. 25, 2004, date of mailing Dec. 2, 2004 (4 pages).
PCT Written Opinion of the International Searching Authority, International Application No. PCT/EP2004/052167 (6 pages).
Supplementary European Search Report, Application No. EP 99908371, date of completion Oct. 22, 2004 (3 pages).
Vetco Offshore Industries, Inc., General Catalog 1970-1971, Vetco® Subsea Systems, cover page, and pp. 4799-4800, 4816-4818 (see numbered p. 4816 for "patented" Vetco H-4 connectors) (6 pages).
Vetco Offshore, Inc., General Catalog 1972-1973, Subsea Systems, cover page, company page and pp. 4498, 4509-4510 (5 pages).
Vetco Offshore, Inc., General Catalog 1974-1975, cover page, company page and pp. 5160, 5178-5179 (5 pages).
Vetco Offshore, Inc., General Catalog 1976-1977, Subsea Drilling and Completion Systems, cover page and pp. 5862-5863, and 5885 (4 pages).
Vetco, General Catalog 1982-1983, cover page and pp. 8454-8455, 8479 (4 pages).
Shaffer, A Varco Company website, Pressure Control While Drilling System, printed Jun. 21, 2004, corresponding website http://www.tulsaequip.com (2 pages).
Precision Drilling Corporation, Performance Drilling by Precision Drilling. A Smart Equation, (see 9th page for "Northland's patented RBOP . . ."), © 2002 Precision Drilling Corporation (12 pages).
Weatherford, RPM System 3000™ Rotating Blowout Preventer—Setting a new standard in Well Control, Weatherford Underbalanced Systems, Brochure #333.01 © 2002-2005 Weatherford (4 pages).
Hannegan, Don, Managed Pressure Drilling in Marine Environments, Drilling Engineering Association Workshop, Moody Gardens, Galveston, Texas, Jun. 22-23, 2004, © 2004 Weatherford (28 pages).
Smith International, Inc., Hold™ 2500 RCD Rotating Control Device web page and brochure, printed Oct. 27, 2004, corresponding website http://www.smith.com/hold2500, Smith Services, A Business Unit of Smith International, Inc. © 2004 Smith International, Inc. (5 pages).
Rehm, Bill, Practical Underbalanced Drilling and Workover, 2002, cover page, title page, copyright page, and pp. 6-1 to 6-9, and 7-1 to 7-9, Petroleum Extension Service—The University of Texas at Austin, © 2002 The University of Texas at Austin (21 pages).
Terwogt, J.H. et al., Pressured Mud Cap Drilling from A Semi-Submersible Drilling Rig, SPE/IADC Drilling Conference held in Amsterdam, The Netherlands, Feb. 23-25, 2005, Paper SPE/IADC 92294, © 2005 SPE/IADC Drilling Conference (6 pages).
Tangedahl, M.J., et al., Rotating Preventers: Technology for better well control, World Oil, Oct. 1992, pp. 63-64 & 66, vol. 213, No. 10, Gulf Publishing Company, Houston, Texas (3 pages).
Partial European Search Report, Application No. EP 05 27 0083, completed Feb. 8, 2006 (5 pages).
Netherlands Search Report, Application No. NL 1026044, date completed Dec. 14, 2005 (3 pages).
International Search Report, Application No. PCT/GB 00/00731 (corresponding to U.S. 6,470,975), completed Jun. 16, 2000 (2 pages).
GB Examination Report, Application No. GB0324939.8 (corresponding to U.S. 6,470,975), Mar. 21, 2006 (6 pages).
GB Examination Report, Application No. GB0324939.8 (corresponding to U.S. 6,470,975), Jan. 22, 2004 (3 pages).
MicroPatent® Family Lookup, U.S. Pub. No. 2003/0106712, printed Jun. 15, 2006 (5 pages).
MicroPatent® Family Lookup, U.S. 6,470,975, printed Jun. 15, 2006 (5 pages).
AU Examination Report, Application No. 28183/00 (corresponding to U.S. 6,470,975), Sep. 9, 2002 (1 page).
NO Examination Report, Application No. 20013953 (corresponding to U.S. Patent No. 6,470,975), first page English translation, Apr. 29, 2003 (3 pages).
Nessa, Dag Oluf et al., Offshore underbalanced drilling system could revive field developments, World Oil®, Jul. 1997, vol. 218, No. 7, cover page and pp. 3, 61-64 and 66 (Part 1), and World Oil®, Oct. 1997, vol. 218, No. 10, cover page and pp. 3, 83-84, 86 and 88 (Part 2) (see 5A, 5G above and 5I below), Gulf Publishing Company, Houston, Texas, © 1997 Gulf Publishing Company (13 pages).
International Search Report, Application No. PCT/GB 00/00731 (corresponding to U.S. 6, 470,975), completed Jun. 16, 2000 (4 pages).
International Preliminary Examination Report, Application No. PCT/GB 00/00731 (corresponding to U.S. 6,470,975), completion Dec. 14, 2000 (7 pages).
NL Examination Report, Application WO 00/52299 (corresponding to this U.S. Appl. No. 10/281,534), completed Dec. 19, 2003 (3 pages).
AU Examination Report, Application No. 28181/00 (corresponding to U.S. 6,263,982), Sep. 6, 2002 (1 page).
EU Examination Report, Application No. WO 00/906522.8-2315 (corresponding to U.S. 6,263,982), Nov. 29, 2004 (44 pages).
NO Examination Report Application No. 20013952 (coresponding to U.S. 6,263,982), two pages English translation, Jul. 22, 2005 (4 pages).
International Preliminary Examination Report, Application No. PCT/GB00/00726 (corresponding to U.S. 6,263,982), completed Jun. 26, 2001 (10 pages).
Written Opinion, International Preliminary Examining Authority, Application No. PCT/GB00/00726 (corresponding to U.S. 6,263,982), mailed Dec. 18, 2000 (7 pages).
International Search Report, Application No. PCT/GB00/00726 (corresponding to U.S. 6,263,982), completed May 3, 2000 (3 pages).
AU Examination Report, Application No. 27822/99 (corresponding to U.S. 6,138,774), Oct. 15, 2001 (1 page).
Supplementary European Search Report, Application No. 99908371.0-1266-US9903888 (corresponding to U.S. 6,138,774), completed Oct. 22, 2004 (3 pages).

No Examination Report, Application No. 20003950 (corresponding to U.S. 6,138,774), one page English translation, Nov. 1, 2004 (3 pages).
International Search Report, Application No. PCT/US99/03888 (corresponding to U.S. 6,138,774), completed Jun. 24, 1999 (6 pages).
Written Opinion, International Preliminary Examining Authority, Application No. PCT/US99/03888 (corresponding to U.S. 6,138,744), mailed Dec. 21, 1999 (5 pages).
International Preliminary Examination Report, Application No. PCT/US99/03888 (corresponding to U.S. 6,138,774), completed May 4, 2000 (15 pages).
EU Examination Report, Application No. 05270083.8-2315 (corresponding to U.S. Pub. No. 2006/0108119 A1, now US 7,487,837 B2 published May 25, 2006), May 10, 2006 (11 pages).
Tangedahl, Michael J. et al., Rotating Preventers: Technology for better well control, World Oil®, Oct. 1992, vol. 213, No. 10, pp. 63-64 and 66 (see YYYY, 5X above), Gulf Publishing Company, Houston, Texas, © 1997 Gulf Publishing Company (3 pages).
GB Search Report, Application No. GB 0325423.2 (corresponding to above U.S. 7,040,394), searched Jan. 30, 2004 (one page).
GB Examination Report, Application No. GB 0325423.2 (corresponding to above 5Z), Jun. 30, 2005 (4 pages).
Dietle, Lannie L. et al., Kalsi Seals Handbook, Doc. 2137 Revision 1 (see in particular Forward p. ii for "Patent Rights"; Appendix A-6 for Kalsi seal part No. 381-6-* and A-10 for Kalsi seal part No. 432-32-* as discussed in U.S. Appl. No. 11/366,078, now US 2006/0144622 A1 at ¶s 70 and 71), Kalsi Engineering, Inc, Sugar Land, Texas © 1992-2005 Kalsi Engineering, Inc. (167 pages).
Fig. 10 and discussion in U.S. Appl. No. 11/366,078 application of Background of Invention (2 pages) (see US Patent Publication No. US2006-0144622 A1 published on Jul. 6, 2006).
Partial European search report R.46 EPC dated Jun. 27, 2007 for European Patent Application EP07103416.9-2315 corresponding to above U.S. Appl. No. 11/366,078, now US 2006/0144622 A1 (5 pages).
Extended European search report R.44 EPC dated Oct. 9, 2007 for European Patent Application 07103416.9-2315 corresponding to above U.S. Appl. No. 11/366,078, now US 2006/0144622 A1 (8 pages).
U.S. Appl. No. 60/079,641, Mudlift System for Deep Water Drilling, filed Mar. 27, 1998, abandoned, but priority claimed in above US 6,230,824 B1 and 6,102,673 and PCT WO99/50524 (54 pages).
U.S. Appl. No. 60/122,530, Concepts for the Application of Rotating Control Head Technology to Deepwater Drilling Operations, filed Mar. 2, 1999, abandoned, but priority claimed in above US 6,470,975 B1 (54 pages).
PCT/GB2008/050239 (corresponding to US2008/0210471 A1) Annex to Form PCT/ISA/206 Communication Relating to the Results of the Partial International Search dated Aug. 26, 2008 (4 pages).
PCT/GB2008/050239 (corresponding to US2008/0210471 A1) International Search Report and Written Opinion of the International Searching Authority (16 pages).
Vetco Gray Product Information CDE-PI-0007 dated Mar. 1999 for 59.0 " Standard Bore CSO Diverter (2 pages) © 1999 by Vetco Gray Inc.
Vetco Gray Capital Drilling Equipment KFDJ and KFDJ Model "J" Diverters (1 page) (no date).
Hydril Blowout Preventers Catalog M-9402 D (44 pages) ©2004 Hydrill Company LP; see annular and ram BOP seals on p. 41.
Hydril Compact GK® 7 1/16"-3000 & 5000 psi Annular Blowout Preventers, Catalog 9503B © 1999 Hydril Company (4 pages).
Weatherford Controlled Pressure Drilling *Williams*® Rotating Marine Diverter Insert (2 pages).
Weatherford Controlled Pressure Drilling Model 7800 Rotating Control Device © 2007 Weatherford(5 pages).
Weatherford Controlled Pressure Drilling® and Testing Services *Williams* ® Model 8000/9000 Conventional Heads © 2002-2006 Weatherford(2 pages).
Weatherford "Real Results Rotating Control Device Resolves Mud Return Issues in Extended-Reach Well, Saves Equipment Costs and Rig Time" © 2007 Weatherford and "Rotating Control Device Ensures Safety of Crew Drilling Surface-Hole Section" © 2008 Weatherford (2 pages).
Washington Rotating Control Heads, Inc. Series 1400 Rotating Control Heads ("Shorty") printed Nov. 21, 2008 (2 pages).
Smith Services product details for Rotating Control Device—RDH 500® printed Nov. 24, 2008 (4 pages).
American Petroleum Institute Specification for Drill Through Equipment—Rotating Control Devices, API Specification 16RCD, First Edition, Feb. 2005 (84 pages).
Weatherford Drilling & Intervention Services Underbalanced Systems RPM System 3000™ Rotating Blowout Preventer, Setting a New Standard in Well Control, An Advanced Well Control System for Underbalanced Drilling Operations, Brochure #333.00, © 2002 Weatherford (4 pages).
Medley, George; Moore, Dennis; Nauduri, Sagar; Signa Engineering Corp.; SPE/IADC Managed Pressure Drilling & Underbalanced Operations (PowerPoint presentation; 22 pages).
Secure Drilling Well Controlled, Secure Drilling™ System using Micro-Flux Control Technology, © 2007 Secure Drilling (12 pages).
The LSU Petroleum Engineering Research & Technology Transfer Laboratory, 10-rate Step Pump Shut-down and Start-up Example Procedure for Constant Bottom Hole Pressure Manage Pressure Drilling Applications (8 pages).
United States Department of the Interior Minerals Management Service Gulf of Mexico OCS Region NTL No. 2008-G07; Notice to Lessees and Operators of Federal Oil, Gas, and Sulphur Leases in the Outer Continental Shelf, Gulf of Mexical OCS Region, Managed Pressure Drilling Projects; Issue Date: May 15, 2008; Effective Date: Jun. 15, 2008; Expiration Date: Jun. 15, 2013 (9 pages).
Gray, Kenneth; Dynamic Density Control Quantifies Well Bore Conditions in Real Time During Drilling; American Oil & Gas Reporter, Jan. 2009 (4 pages).
Kotow, Kenneth J.; Pritchard, David M.; Riserless Drilling with Casing: A New Paradigm for Deepwater Well Design, OTC-19914-PP, © 2009 Offshore Technology Conference, Houston, TX May 4-7, 2009 (13 pages).
Hannegan, Don M.; Managed Pressure Drilling—A New Way of Looking at Drilling Hydraulics—Overcoming Conventional Drilling Challenges; SPE 2006-2007 Distinguished Lecturer Series presentation (29 pages).
Turck Works Industrial Automation; Factor 1 Sensing for Metal Detection (2 pages) (no date).
Balluff Sensors Worldwide; Object Dectection Catalog 08/09—Industive Proximity Sensors for Non-Contact Detection of Metallic Targets at Ranges Generally under 50mm (2 inches); Linear Position and Measurement; Linear Position Transducers; Inductive Distance Sensors; Photoelectric Distance Sensors; Magneto-Inductive Linear Position Sensors; Magnetic Linear/Rotary Encoder System; printed Dec. 23, 2008 (8 pages).
AC 2-Wire Tubular Sensors, Balluff product catalog pp. 1.109-1.120 (12 pages) (no date).
DC 2-Wire Tubular Sensors, Balluff product catalog pp. 1.125-1.136 (12 pages) (no date).
Analog Inductive Sensors, Balluff product catalog pp. 1.157-1.170 (14 pages) (no date).
DC 3-/4-Wire Inductive Sensors, Balluff product catalog pp. 1.72-1. 92 (21 pages).
Selecting Position Transducers: How to Choose Among Displacement Sensor Technologies; How to Choose Among Draw Wire, LVDT, RVDT, Potentiometer, Optical Encoder, Ultrasonic, Magnetostrictive, and Other Technologies; © 2009 M-I, LLC © 1996-2010 Space Age Control, Inc., printed Feb. 18, 2010 (6 pages).
Liquid Flowmeters, Omega.com website; printed Jan. 26, 2009 (13 pages).
Super Autochoke—Automatic Pressure Regulation Under All Conditions © 2009 M-I, LLC; MI Swaco website; printed Apr. 2, 2009 (1 page).
Extended European Search Report R.61 EPC dated Sep. 16, 2010 for European Patent Application 08166660.4-1266/2050924 corresponding to above U.S. Appl. No. 11/975,554, now US 2009/0101351 A1 (7 pages).

* cited by examiner

UNIVERSAL MARINE DIVERTER CONVERTER

CROSS-REFERENCE TO RELATED APPLICATIONS

N/A

STATEMENT REGARDING FEDERALLY SPONSORED RESEARCH OR DEVELOPMENT

N/A

REFERENCE TO MICROFICHE APPENDIX

N/A

BACKGROUND OF THE INVENTION

1. Field of the Invention

This invention relates to the field of oilfield equipment, and in particular to a system and method for the conversion of a conventional annular blow-out preventer (BOP) between an open and non-pressurized mud-return system and a closed and pressurized mud-return system for managed pressure drilling or underbalanced drilling.

2. Description of the Related Art

Marine risers extending from a well head on the floor of the ocean have traditionally been used to circulate drilling fluid back to a drilling structure or rig through the annular space between the drill string and the internal diameter of the riser. The riser must be large enough in internal diameter to accommodate the largest drill string that will be used in drilling a borehole. For example, risers with internal diameters of 19½ inches (49.5 cm) have been used, although other diameters can be used. An example of a marine riser and some of the associated drilling components, such as shown herein in FIGS. 1 and 2, is proposed in U.S. Pat. No. 4,626,135.

The marine riser is not generally used as a pressurized containment vessel during conventional drilling operations. Pressures contained by the riser are generally hydrostatic pressure generated by the density of the drilling fluid or mud held in the riser and pressure developed by pumping of the fluid to the borehole. However, some remaining undeveloped reservoirs are considered economically undrillable using conventional drilling operations. In fact, studies sponsored by the U.S. Department of the Interior, Minerals Management Service and the American Petroleum Institute have concluded that between 25% and 33% of all remaining undeveloped reservoirs are not drillable using conventional overbalanced drilling methods, caused in large part by the increased likelihood of well control problems such as differential sticking, lost circulation, kicks, and blowouts.

Drilling hazards such as gas and abnormally pressured aquifers relatively shallow to the mud line present challenges when drilling the top section of many prospects in both shallow and deep water. Shallow gas hazards may be sweet or sour and, if encountered, reach the rig floor rapidly. Blowouts at the surface have occurred due to lack of time to close the rigs BOP. If sour, even trace amounts of such escaping gasses create health, safety and environmental (HSE) hazards, as they are harmful to humans and detrimental to the environment. There are U.S. and Canadian regulatory restrictions on the maximum amount of exposure workers can have to such gases. For example, the Occupational Safety and Health Administration (OSHA) sets an eight-hour daily limit for a worker's exposure to trace amounts of H2S gas when not wearing a gas mask.

Pore pressure depletion, narrow drilling windows due to tight margins between formation pressure and fracture pressure of the open hole, growing requirement to drill in deeper water, and increased drilling costs indicate that the amount of known reservoirs considered economically un-drillable with conventional drilling operations will continue to increase. New and improved techniques, such as managed pressure drilling and underbalanced drilling, have been used successfully throughout the world in certain offshore drilling environments. Managed pressure drilling has recently been approved in the Gulf of Mexico by the U.S. Department of Interior, Minerals Management Service, Gulf of Mexico Region. Managed pressure drilling is an adaptive drilling process that does not invite hydrocarbons to the surface during drilling. Its primary purpose is to more precisely manage the wellbore pressure profile while keeping the equivalent mud weight above the formation pressure at all times, whether circulating or shut in to make jointed pipe connections. To stay within the drilling window to a deeper depth with the mud in the hole at the time, for example to drill a deeper open hole perhaps to eliminate need for another casing string, the objective may be to drill safely at balance, nearer balanced, or by applying surface backpressure to achieve a higher equivalent mud weight (EMW) than the hydrostatic head of the drilling fluid. Underbalanced drilling is drilling with the hydrostatic head of the drilling fluid and the equivalent mud weight when circulating designed to be lower than the pressure of the formations being drilled. The hydrostatic head of the fluid may naturally be less than the formation pressure, or it can be induced.

These new and improved techniques present a need for pressure management devices, such as rotating control heads or devices (referred to as RCDs) and rotating marine diverters. RCDs, similar to the one disclosed in U.S. Pat. No. 5,662,181, have provided a dependable seal between a rotating tubular and the marine riser for purposes of controlling the pressure or fluid flow to the surface while drilling operations are conducted. Typically, an inner portion or member of the RCD is designed to seal around a rotating tubular and rotate with the tubular using internal sealing element(s) and bearings. Additionally, the inner portion of the RCD allows the tubular to move axially and slidably through the RCD. The term "tubular" as used herein means all forms of drill pipe, tubing, casing, drill collars, liners, and other tubulars for oilfield operations as are understood in the art.

U.S. Pat. No. 6,913,092 B2 proposes a seal housing comprising a RCD positioned above sea level on the upper section of a marine riser to facilitate a closed and mechanically controlled pressurized system that is useful in underbalanced subsea drilling. An internal running tool is proposed for positioning the RCD seal housing onto the riser and facilitating its attachment thereto. A remote controlled external disconnect/connect clamp is proposed for hydraulically clamping the bearing and seal assembly of the RCD to the seal housing.

It has also been known to use a dual density fluid system to control formations exposed in the open borehole. See Feasibility Study of a Dual Density Mud System For Deepwater Drilling Operations by Clovis A. Lopes and Adam T. Bourgoyne, Jr., ©1997 Offshore Technology Conference. As a high density mud is circulated to the rig, gas is proposed in the 1997 paper to be injected into the mud column in the riser at or near the ocean floor to lower the mud density. However, hydrostatic control of formation pressure is proposed to be maintained by a weighted mud system, that is not gas-cut, below the seafloor.

U.S. Pat. No. 6,470,975 B1 proposes positioning an internal housing member connected to a RCD below sea level with a marine riser using an annular blowout preventer ("BOP") having a marine diverter, an example of which is shown in the above discussed U.S. Pat. No. 4,626,135. The internal housing member is proposed to be held at the desired position by closing the annular seal of the BOP so that a seal is provided between the internal housing member and the inside diameter of the riser. The RCD can be used for underbalanced drilling, a dual density fluid system, or any other drilling technique that requires pressure containment. The internal housing member is proposed to be run down the riser by a standard drill collar or stabilizer.

U.S. Pat. No. 7,159,669 B2 proposes that the RCD held by an internal housing member be self-lubricating. The RCD proposed is similar to the Weatherford-Williams Model 7875 RCD available from Weatherford International, Inc. of Houston, Tex.

U.S. Pat. No. 6,138,774 proposes a pressure housing assembly containing a RCD and an adjustable constant pressure regulator positioned at the sea floor over the well head for drilling at least the initial portion of the well with only sea water, and without a marine riser.

Pub. No. US 2006/0108119 A1 proposes a remotely actuated hydraulic piston latching assembly for latching and sealing a RCD with the upper section of a marine riser or a bell nipple positioned on the riser. As best shown in FIG. 2 of the '119 publication, a single latching assembly is proposed in which the latch assembly is fixedly attached to the riser or bell nipple to latch an RCD with the riser. As best shown in FIG. 3 of the '119 publication, a dual latching assembly is also proposed in which the latch assembly itself is latchable to the riser or bell nipple, using a hydraulic piston mechanism.

Pub. No. US 2006/0144622 A1 proposes a system for cooling the radial seals and bearings of a RCD. As best shown in FIG. 2A of the '622 publication, hydraulic fluid is proposed to both lubricate a plurality of bearings and to energize an annular bladder to provide an active seal that expands radially inward to seal around a tubular, such as a drill string.

Marine BOP diverters are used in conventional hydrostatic pressure drilling on drilling rigs or structures. Manufacturers of marine BOP diverters include Hydril Company, Vetco Gray, Inc., Cameron, Inc., and Dril-Quip, Inc., all of Houston, Tex. When the BOP diverter's seals are closed upon the drill string, fluid is safely diverted away from the rig floor. However, drilling operations must cease because movement of the drill string will damage or destroy the non-rotating annular seals. During normal operations the diverter's seals are open. There are a number of offshore drilling circumstances, not related to well control, where it would be advantageous to rotate and move the drill string within a marine diverter with closed seals. Two examples are: 1) slow rotation to prevent the drill string from sticking when circulating out riser gas, which in deep wells can take many hours, and 2) lifting the drill string off the bottom to minimize annulus friction pressure after circulating out riser gas and before resuming drilling operations. Being able to drill with a closed seal would also allow drilling ahead with a managed back-pressure applied to the annulus while maintaining a more precise well bore pressure profile.

A marine diverter converter housing for positioning with an RCD, as shown in FIG. 3, has been used in the recent past. However, the housing must match the inside profile of one of the many makes and models of BOP marine diverters, some of which are disclosed above, in which it is used. Moreover, the annular elastomer packer seal and hydraulic actuated piston therein must be removed before the converter housing is positioned therein.

The above discussed U.S. Pat. Nos. 4,626,135; 5,662,181; 6,138,774; 6,470,975 B1; 6,913,092 B2; and 7,159,669 B2; and Pub. Nos. U.S. 2006/0108119 A1 and U.S. 2006/0144622 A1 are incorporated herein by reference for all purposes in their entirety. With the exception of the '135 patent, all of the above referenced patents and patent publications have been assigned to the assignee of the present invention. The '135 patent is assigned on its face to the Hydril Company of Houston, Tex.

While drilling rigs are usually equipped with an annular BOP marine diverter used in conventional hydrostatic pressure drilling, a need exists for a system and method to efficiently and safely convert the annular BOP marine diverters between conventional drilling and managed pressure drilling or underbalanced drilling. The system and method would allow for the conversion between a conventional annular BOP marine diverter and a rotating marine diverter. It would be desirable for the system and method to require minimal human intervention, particularly in the moon pool area of the rig, and to provide an efficient and safe method for positioning and removing the equipment. It would further be desirable for the system to be compatible with a variety of different types and sizes of RCDs and annular BOP marine diverters.

BRIEF SUMMARY OF THE INVENTION

A system and method is disclosed for converting between an annular BOP marine diverter used in conventional hydrostatic pressure drilling and a rotating marine diverter using a rotating control device for managed pressure drilling or underbalanced drilling. The rotating control device may be clamped or latched with a universal marine diverter converter (UMDC) housing. The UMDC housing has an upper section and a lower section, with a threaded connection therebetween, which allows the UMDC housing to be configured to the size and type of the desired annular BOP marine diverter housing. The UMDC housing can be positioned with a hydraulic running tool so that its lower section can be positioned with the annular BOP marine diverter.

BRIEF DESCRIPTION OF THE DRAWINGS

A better understanding of the present invention can be obtained with the following detailed descriptions of the various disclosed embodiments in the drawings.

DETAILED DESCRIPTION OF THE INVENTION

Figure 1:
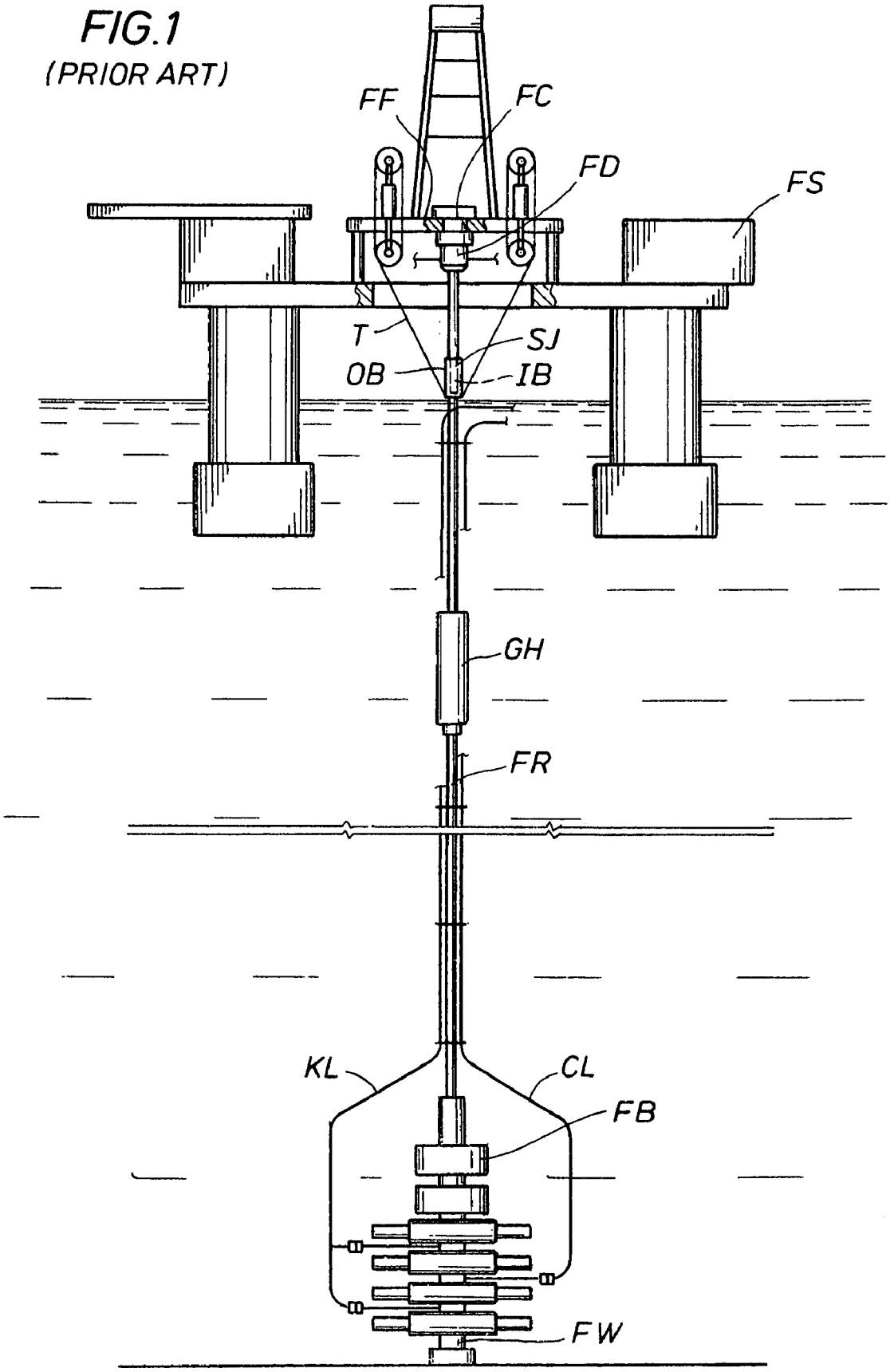
FIG.1 (PRIOR ART)
FIG. 1 is an elevational view of an exemplary embodiment of a floating semi-submersible drilling rig showing a BOP stack on the ocean floor, a marine riser, a subsurface annular BOP marine diverter, and an above surface diverter.
Figure 2:
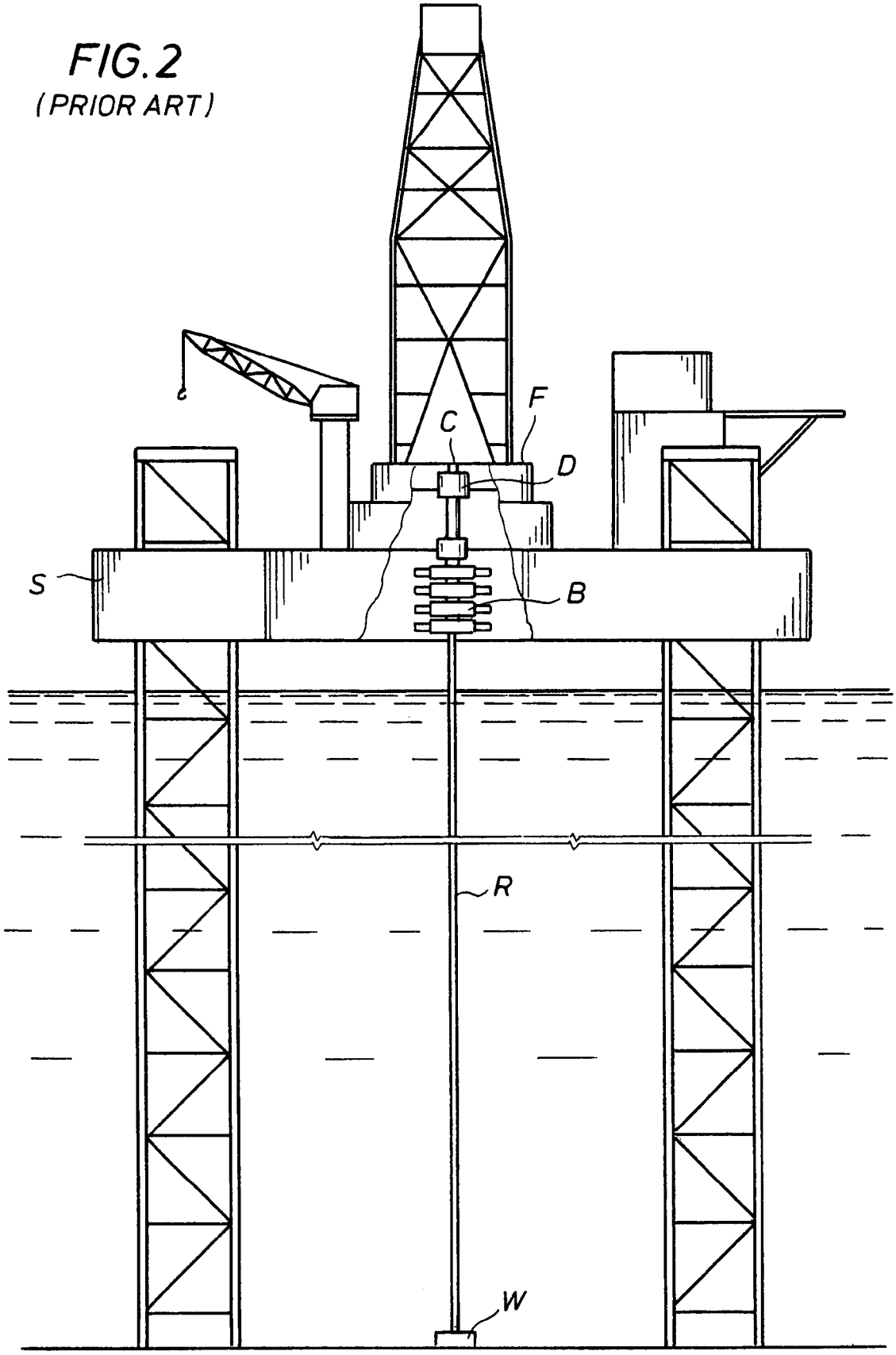
FIG. 2 (PRIOR ART)
FIG. 2 is an exemplary embodiment of a fixed jack up drilling rig with the BOP stack and a diverter above the surface of the water.

Generally, the present invention involves a system and method for converting between an annular BOP marine diverter (FD, D) used in a conventional open and non-pressurized mud return system for hydrostatic pressure drilling, and a rotating marine diverter, used in a closed and pressurized mud-return system for managed pressure or underbalanced drilling, using a universal marine diverter converter (UMDC) housing, generally indicated as 24, 24A, 24B, 24C, and 24D in FIGS. 4-7, clamped (FIGS. 4, 5A, 6, and 7) or latched (FIG. 5) with a RCD (7, 10, 100). Each illustrated UMDC housing (24, 24A, 24B, 24C, 24D) has an upper section (3, 26, 104) and a lower section (2, 28, 50, 66, 106), with a threaded connection (30, 86, 114) therebetween, which allows the UMDC housing (24, 24A, 24B, 24C, 24D) to be easily configured to the size and type of the annular BOP marine diverter (FD, D) and to the desired RCD (7, 10, 100). It is contemplated that several lower housing sections (2, 28, 50, 66, 106) that match typical annular BOP marine diverters (FD, D) may be stored on the drilling rigs, as shown in FIGS. 1 and 2. The UMDC housing (24, 24A, 24B, 24C, 24D) may be secured in different size and types of BOP marine diverter housings (38, 60, 70, 80, 118) using different configurations of conventional elastomer seals (42, 43, 64, 120), as will be discussed below in detail. It is contemplated that the UMDC housing (24, 24A, 24B, 24C, 24D) will be made of steel, although other materials may be used. Examples of RCDs (7, 10, 100) are disclosed in U.S. Pat. Nos. 5,662,181, 6,470,975 B1, and 7,159,669 B2, and are available commercially as Weatherford-Williams Models 7875 and 7900 from Weatherford International, Inc. of Houston, Tex.

Exemplary prior art drilling rigs or structures, generally indicated as FS and S, are shown in FIGS. 1 and 2. Although an offshore floating semi-submersible rig FS is shown in FIG. 1, and a fixed jack-up rig S is shown in FIG. 2, other drilling rig configurations and embodiments are contemplated for use with the present invention for both offshore and land drilling. For example, the present invention is equally applicable for drilling rigs such as semi-submersibles, submersibles, drill ships, barge rigs, platform rigs, and land rigs. Turning to FIG. 1, an exemplary embodiment of a drilling rig FS is shown. A BOP stack FB is positioned on the ocean floor over the wellhead FW. Conventional choke CL and kill KL lines are shown for well control between the drilling rig FS and the BOP stack FB.

A marine riser FR extends between the top of the BOP stack FB and to the outer barrel OB of a high pressure slip or telescopic joint SJ located above the water surface with a gas handler annular BOP GH therebetween. The slip joint SJ may be used to compensate for relative movement of the drilling rig FS to the riser FR when the drilling rig FS is used in conventional drilling. A BOP marine diverter FD is attached to the inner barrel IB of the slip joint SJ under the rig deck or floor FF. Tension support lines T connected to a hoist and pulley system on the drilling rig FS support the upper portion of the riser FR. FIG. 2 does not illustrate a slip joint SJ since the rig S is fixed. However, the BOP stack B is positioned above the surface of the water in the moon pool area under the rig deck or floor F.

Figure 3:
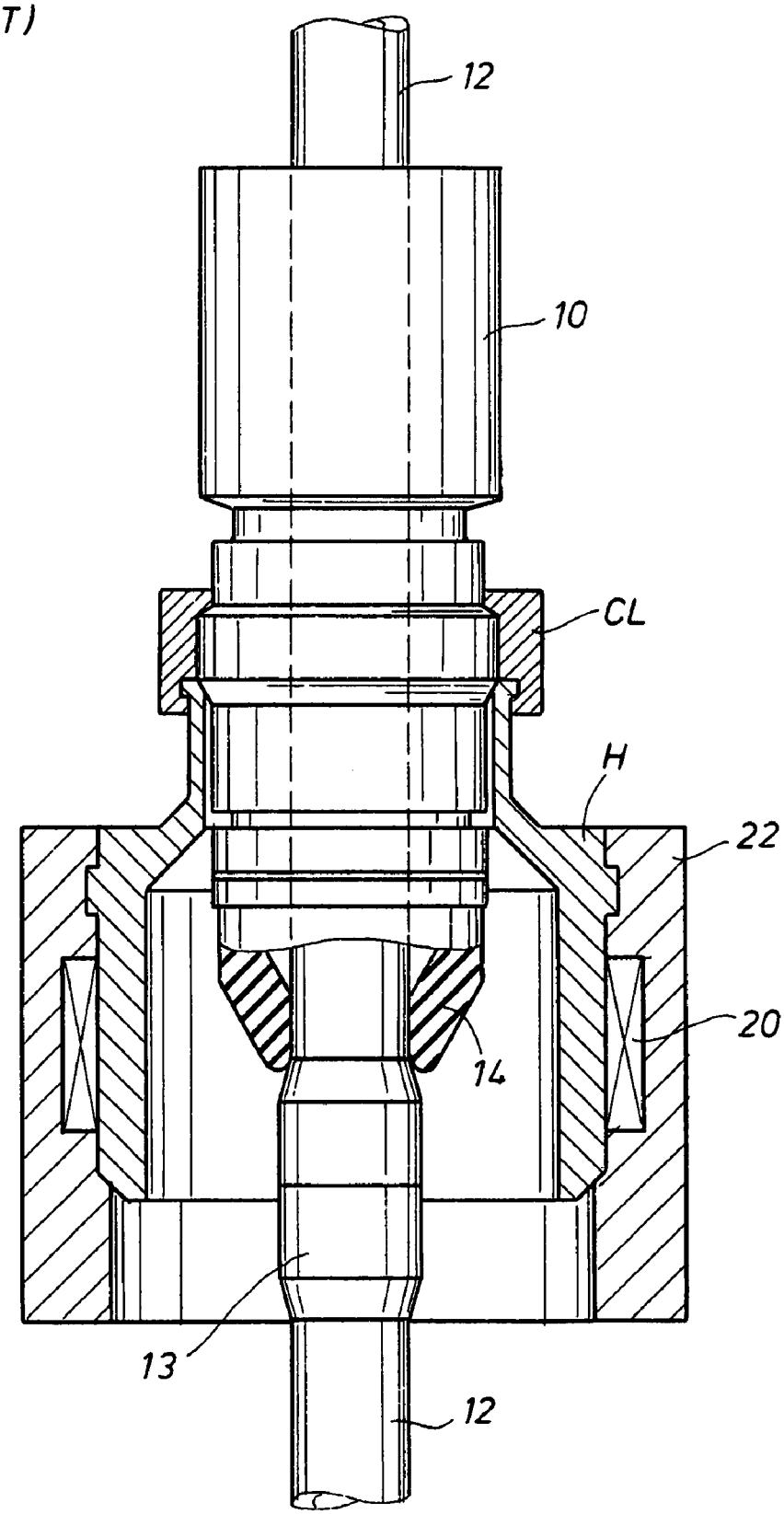
FIG. 3 (PRIOR ART)
FIG. 3 is a cut away section elevational view of a RCD clamped to a marine diverter converter housing, which housing has been attached to an exemplary embodiment of an annular BOP marine diverter cylindrical housing shown in section with its annular elastomer packer seal and pistons removed.

In FIG. 3, a prior art built-to-fit marine diverter converter housing H is attached with a cylindrical marine housing 22 after its annular elastomer packer seal and hydraulic actuated piston have been removed. Seal insert 20 seals the marine diverter converter housing H with cylindrical marine housing 22. RCD 10 is clamped to housing H by radial clamp CL. Drill string tubular 12 is inserted through RCD 10 so that joint 13 supports RCD 10 and its housing H by the RCD 10 lower stripper rubber 14 as the RCD 10 is run into marine housing 22. As can now be understood, the prior art marine diverter converter housing H would be built-to-fit different manufacturer's marine housings 22. Moreover, the prior art marine diverter converter housing H requires that the annular elastomer packer seal and hydraulic actuated piston be removed before installation.

Figure 4:
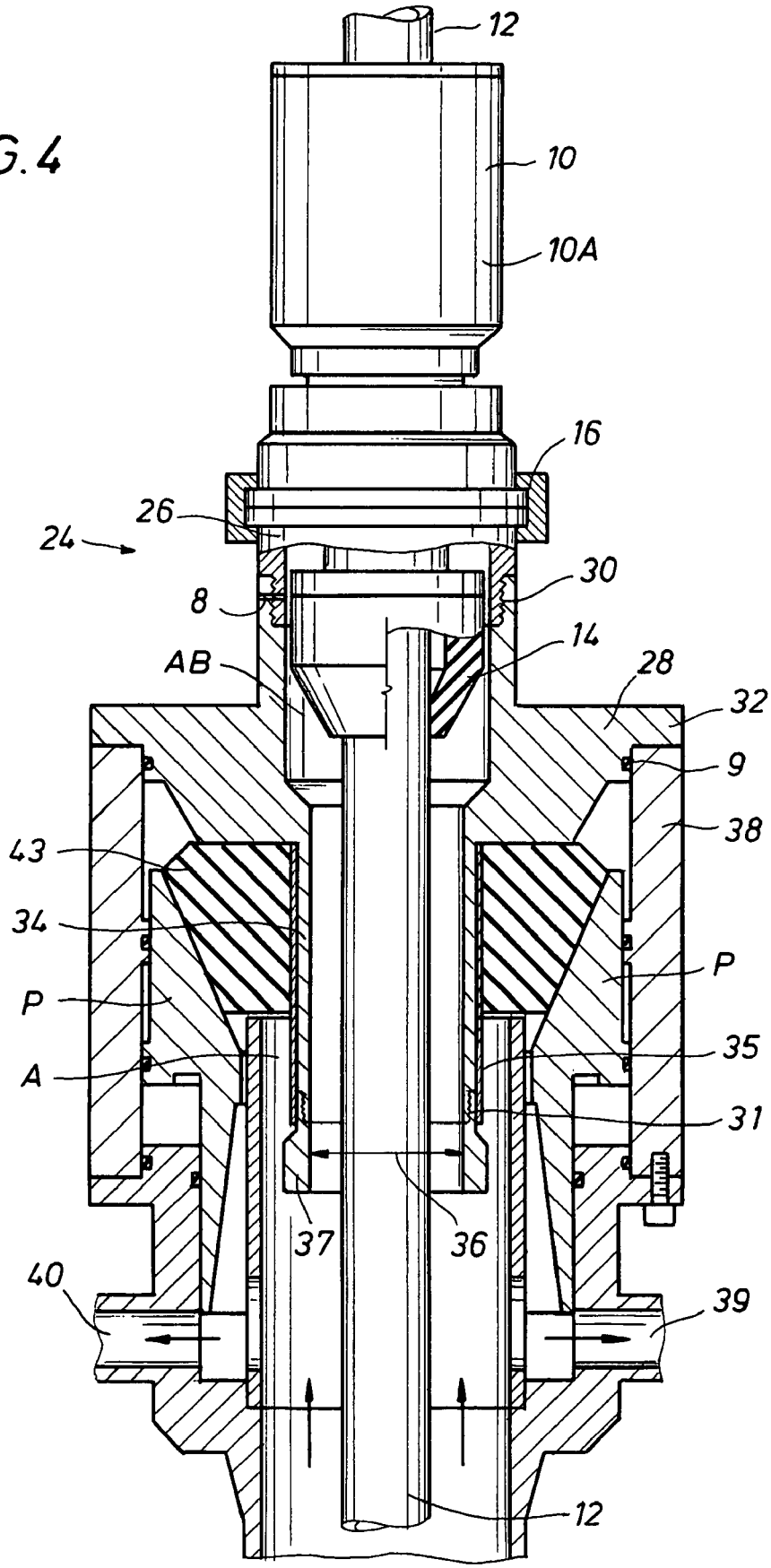
FIG. 4 is a cut away section elevational view of a RCD clamped to a UMDC housing of the present invention, which UMDC has been positioned in an exemplary embodiment of a marine diverter cylindrical housing having a conventional annular elastomer packer seal therein.

FIG. 4 shows one embodiment of a UMDC housing 24 of the present invention, which has upper section 26 and lower section 28. Lower housing section 28 includes a circumferential flange 32, a cylindrical insert 34, and an upset ring or holding member 37. Upper housing section 26 is threadably connected with lower section 28 at threaded connection 30. Holding member 37 is threadably connected with cylindrical insert 34 at threaded connection 31. Threaded connection 31 allows both different outside diameter holding members 37 to be positioned on the same cylindrical insert 34 and a sleeve of elastomer to be received on insert 34, as will be discussed below in detail. It is contemplated that threaded connection 31 may use a reverse (left hand) thread that tightens in the direction of rotation of drill string tubulars 12 for drilling. It is also contemplated that threaded connection 30 may use conventional right hand threads. It is also contemplated that there may be no threaded connection 31, so that cylindrical insert 34 and holding member 37 are integral. One or more anti-rotation pins 8 may be placed through aligned openings in threaded connection 30 after the upper 26 and lower 28 sections are threadably connected to insure that the connection 30 does not become loosened, such as when the drill string 12 is lifted off bottom and the torqued drill string returns to equilibrium.

Figure 5:
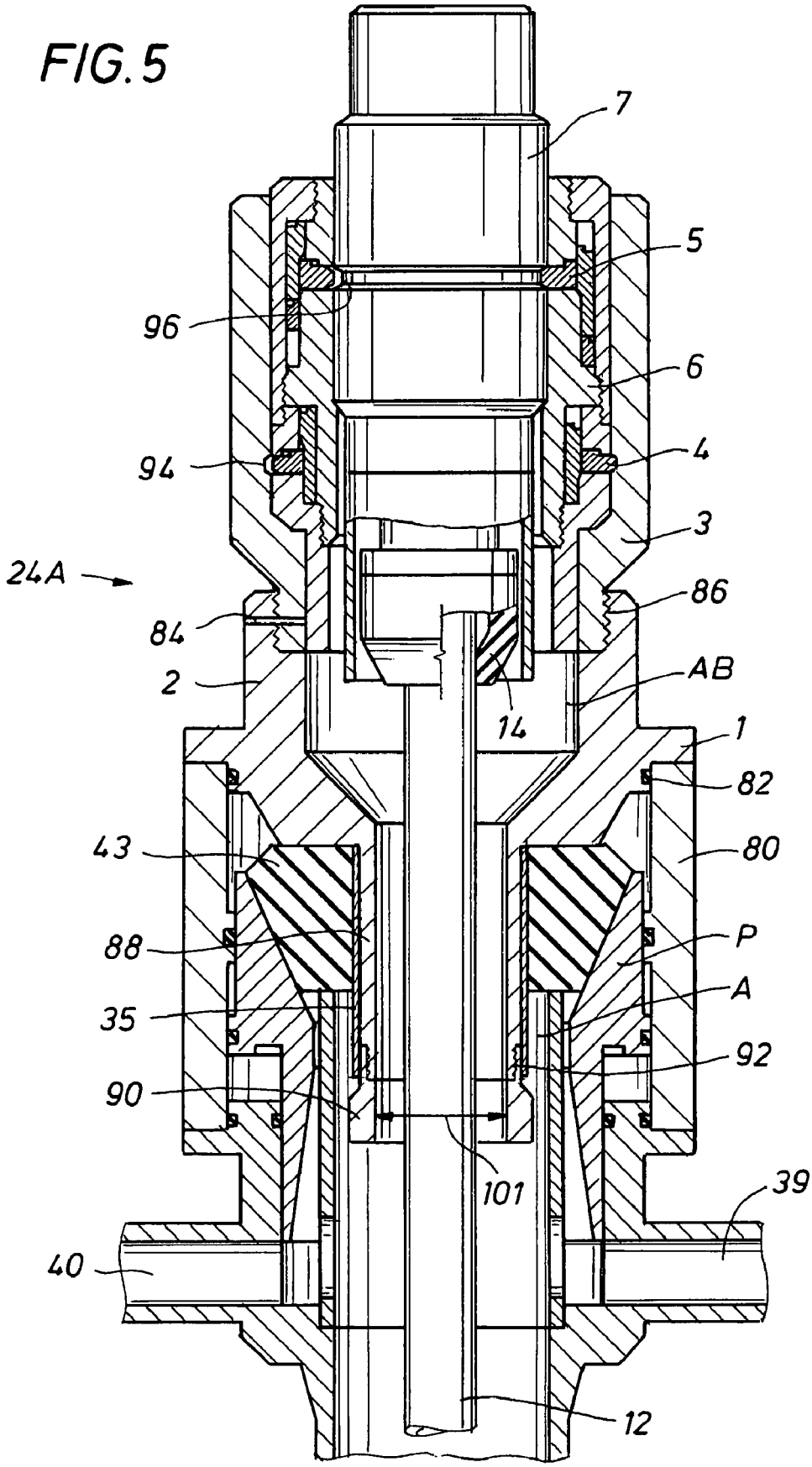
FIG. 5 is a cut away section elevational view of a RCD latched to a UMDC housing of the present invention, which UMDC has been positioned in an exemplary embodiment of a marine diverter cylindrical housing having a conventional annular elastomer packer seal therein.
Figure 6:
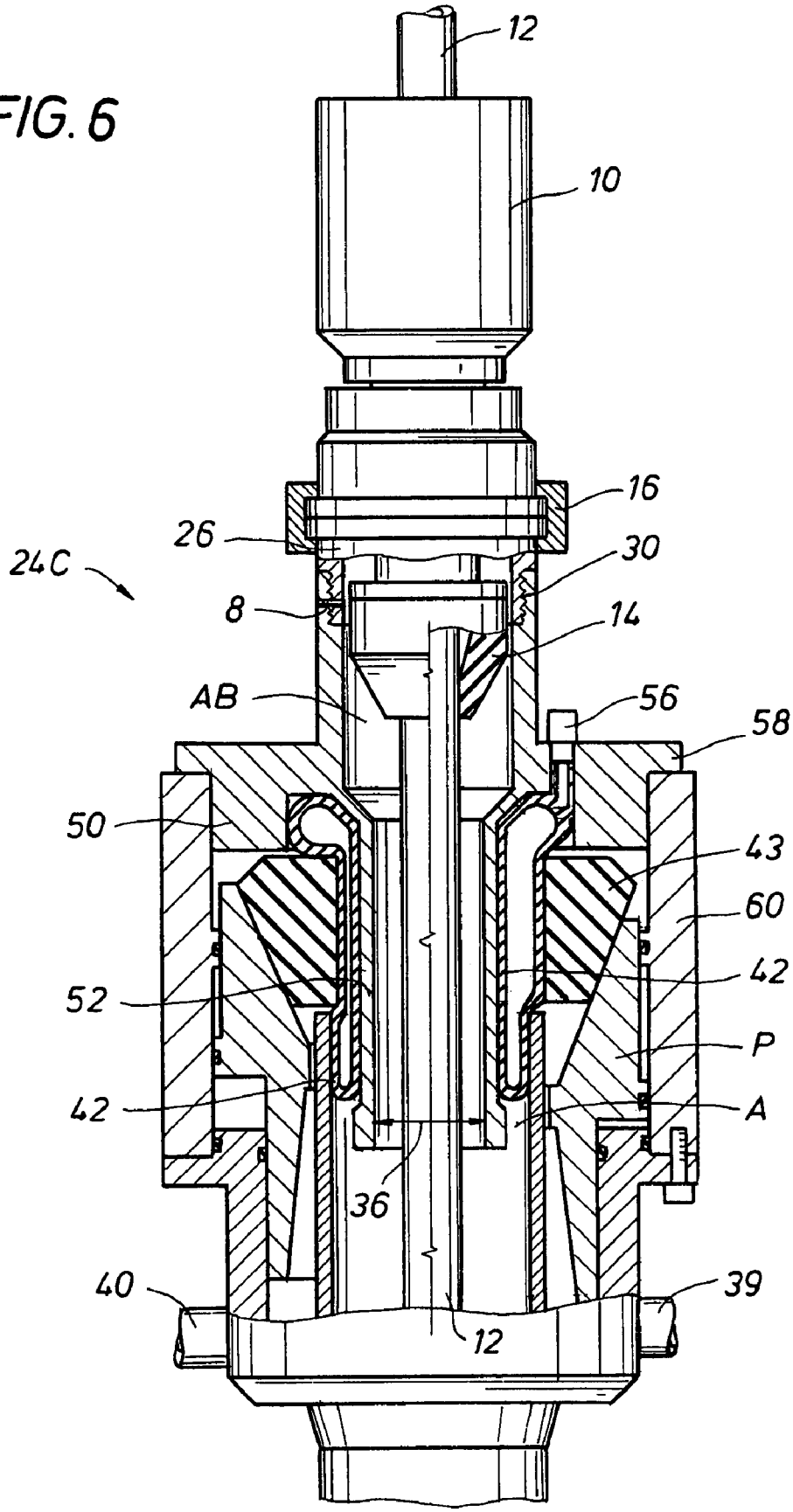
FIG. 6 is a similar view to FIG. 4, except with a split view showing on the right side of the vertical axis the conventional annular elastomer packer seal engaging a conventional active inflatable elastomer annular seal, and on the left side the conventional annular packer seal further compressing the conventional inflatable annular elastomer seal.
Figure 7:
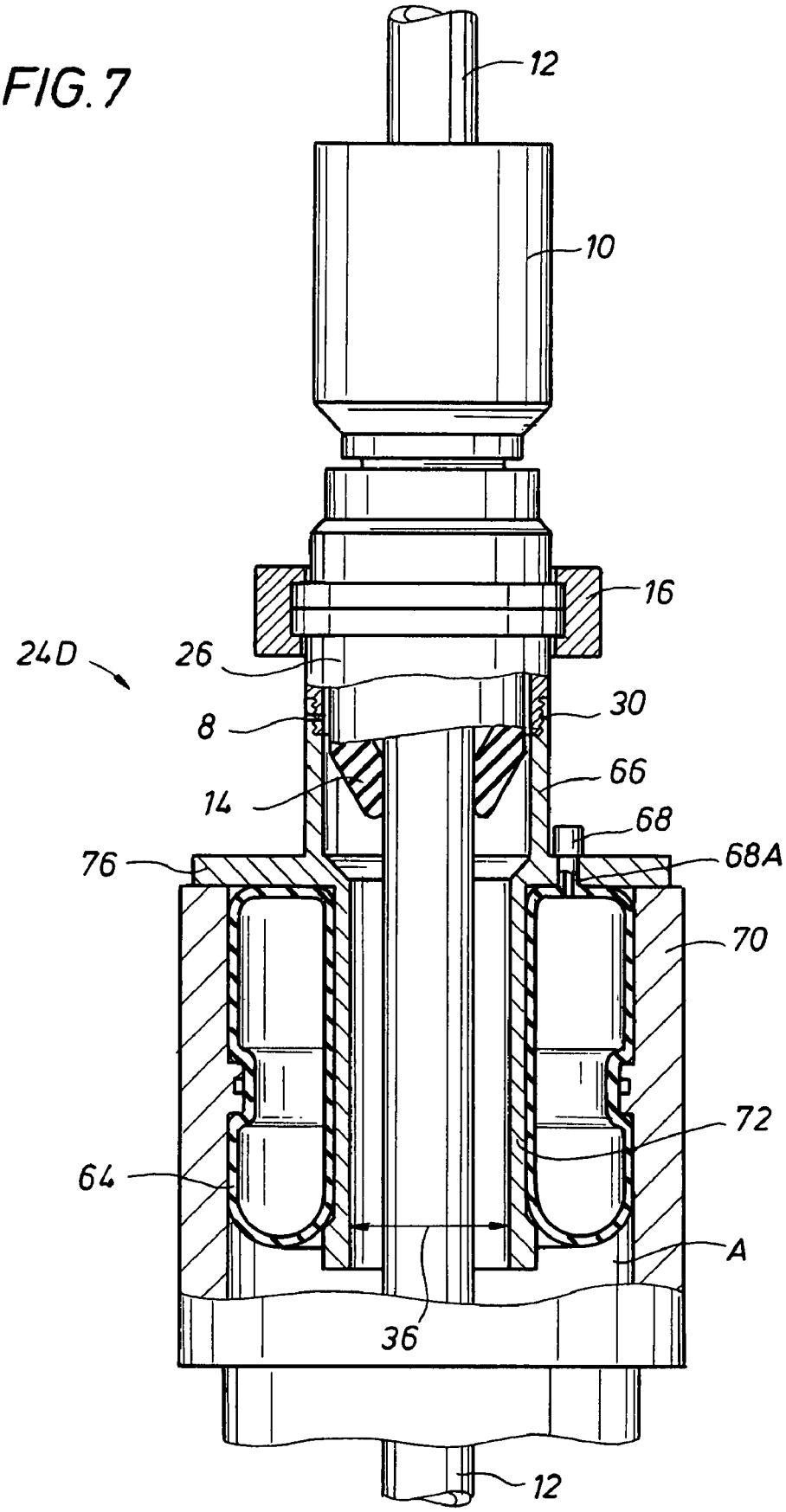
FIG. 7 is a similar view to FIG. 4, except with the annular elastomer packer seal removed, and a conventional active inflatable annular seal installed.

RCD 10 may be radially clamped with clamp 16 to upper section 26. RCD 10 has a lower stripper rubber seal 14 and an upper stripper rubber seal, which is not shown, but disposed in pot 10A. It should be understood that different types of RCDs (7, 10, 100) may be used with all the embodiments of the UMDC housing (24, 24A, 24B, 24C, 24D) shown in FIGS. 4-7, including RCDs (7, 10, 100) with a single stripper rubber seal, or dual stripper rubber seals with either or both passive or active seals. Seal 14 seals the annulus AB between the drill pipe tubular 12 and the UMDC housing (24, 24A, 24B, 24C, 24D). Clamp 16 may be manual, hydraulic, pneumatic, mechanical, or some other form of remotely operated clamping means. Flange 32 of lower section 28 of UMDC housing 24 may rest on marine housing 38, and be sealed with radial seal 9. The outside diameter of flange 32, like flanges (1, 58, 76, 116) in FIGS. 5-7, is smaller than the typical 49½ inch (1.26 m) inside diameter of an offshore rig's rotary table. Marine housing 38, like marine housings (60, 70, 80, 118) in FIGS. 5-7, may vary in inside diameter size, such as for example 30 inches (76 cm) or 36 inches (91.4 cm). It is contemplated that the outside diameter of flange 32 may be greater than the outside diameter of marine housing 38, such that flange 32 may extend outwardly from or overhang marine housing 38. For example, it is contemplated that the outside diameter of flange 32, like flanges (1, 58, 76, 116) in FIGS. 5-7, may be 48 inches (1.2 m) or at least less than the inside diameter of the rig's rotary table. However, other diameter sizes are contemplated as well. It is also contemplated that flange 32 may be positioned atop a row of stud bolts that are typical on many designs of marine diverters D to fasten their tops to their housings. It is contemplated that the top of marine housing 38 does not have to be removed, although it may be removed if desired.

Continuing with FIG. 4, UMDC housing 24 may be positioned with marine housing 38 with a conventional annular elastomer packer seal 43 of the BOP marine diverter, such as described in U.S. Pat. No. 4,626,135, which annular elastomer packer seal 43 is moved by annular pistons P. Annular seal 43 compresses on cylindrical insert 34 and seals the annular space A between cylindrical insert 34 and marine diverter housing 38. Although an annular elastomer packer seal 43 is shown, other conventional passive and active seal configurations, some of which are discussed below, are contemplated. If an elastomer seal, such as seal 43 is used, UMDC housing 24 may be configured as shown in FIGS. 2, 5, and 6 of U.S. Pat. No. 6,470,975 B1. It is also contemplated that that a mechanical packer seal, as known to those skilled in the art, may be used. Outlets (39, 40) in marine diverter housing 38 allow return flow of drilling fluid when the pistons P are raised as shown in FIG. 4, as is discussed in detail below.

An elastomer layer or coating 35 may be laid or placed radially on the outer surface of cylindrical insert 34 so that the annular elastomer packer seal 43 engages layer 35. Holding member 37 may be removed from cylindrical insert 34. It is also contemplated that layer 35 may be a wrap, sleeve, molding, or tube that may be slid over cylindrical insert 34 when holding member 37 is removed. Layer 35 may be used with any embodiment of the UMDC housing (24, 24A, 24B, 24C, 24D) of the present invention. Other materials besides elastomer are contemplated for layer 35 that would similarly seal and/or grip. It is contemplated that materials resistant to solvents may be used, such as for example nitrile or polyurethane. It is further contemplated that materials that are relatively soft and compressible with a low durometer may be used. It is also contemplated that materials with a high temperature resistance may be used. Layer 35 seals and grips with the annular elastomer packer seal 43, or such other annular seal as is used, including conventional inflatable active seals (42, 64) as discussed below in detail. It is contemplated that elastomer layer 35 may be ½ inches (1.3 cm) thick, although other thicknesses are contemplated as well and may be desired when using different materials. Such a layer 35 is particularly useful to prevent slippage and to seal when an elastomer seal, such as elastomer packer seal 43, is used, since the surface area of contact between the seal 43 and the insert 34 or the layer 35 is relatively small, such as for example eight to ten inches (20.3 to 25.4 cm). It is further contemplated that an adhesive may be used to hold the wrap, sleeve, molding, or tube layer 35 in position on cylindrical insert 34. It is also contemplated that layer 35 may be a spray coating. It is contemplated that the surface of layer 35 may be gritty or uneven to enhance its gripping capability. It is also contemplated that layer 35 may be vulcanized. The internal diameter 36 of the cylindrical insert 34 and/or holding member 37 varies in size depending on the diameter of marine housing 38. It is contemplated that the internal diameter 36 may be from eleven inches to thirty-six inches (27.9 to 91.4 cm), with twenty-five inches (63.5 cm) being a typical internal diameter. However, other diameters and sizes are contemplated, as well as different configurations referenced herein.

FIG. 5 shows a UMDC housing 24A of the present invention, which has upper section 3 and lower section 2. Upper section 3 is shown as a housing receiving a dual latching assembly 6. Lower housing section 2 includes circumferential flange 1, cylindrical insert 88, and holding member or upset ring 90. Upper housing section 3 is threadably connected with lower section 2 at threaded connection 86, which allows lower section 2 sized for the desired marine housing 80 and upper section 3 sized for the desired RCD 7 to be connected. Holding member 90 is threadably connected with lower cylindrical insert 88 at threaded connection 92. Threaded connection 92 allows different outside diameter holding members to be positioned on the same cylindrical insert 88 and/or to receive layer 35 thereon, as discussed above. It is contemplated that threaded connection 92 may use a reverse (left hand) thread that preferably tightens in the direction of rotation of drill string tubulars for drilling. It is also contemplated that threaded connection 86 may use a conventional right hand thread. It is also contemplated that there may be no threaded connections (86, 92) if the upper section 3 and lower section 2 are integral. One or more anti-rotation pins 84 may be placed through aligned openings in threaded connection 86 after the upper section 3 and lower section 2 are threadably connected to insure that the connection 86 does not become loosened, such as, discussed above, when the drill string 12 is lifted off bottom.

As best shown in FIG. 5, RCD 7 may be latched with dual latching assembly 6, such as proposed in Pub. No. US 2006/0108119 A1 and shown in FIG. 3 of the '119 publication. Radial latching formation or retaining member 4 may be positioned in radial groove 94 of upper housing section 3 using a hydraulic piston mechanism. Radial latching formation or retaining member 5 may be positioned in radial groove 96 of RCD 7 using a hydraulic piston mechanism. Dual latching assembly 6 may be manual, mechanical, hydraulic, pneumatic, or some other form of remotely operated latching means. It is also contemplated that a single latching assembly, as proposed in Pub. No. US 2006/0108119 A1 and shown in FIG. 2 of the '119 publication, may be used instead of dual latching assembly 6. It is contemplated that such single latching assembly may be attached to upper housing section 3, such as for example by bolting or welding, or it may be manufactured as part of upper housing section 3. As can now be understood, a latching assembly, such as assembly 6, allows RCD 7 to be moved in and out of UMDC housing 24A, such as for example checking on the condition of or replacing lower stripper rubber seal 14 when time is of the essence.

While RCD 7 has only a lower stripper rubber seal 14 (and no upper stripper rubber seal), it should be understood that different types of RCDs (7, 10, 100) may be positioned in UMDC housing 24A, including RCDs (7, 10, 100) with dual stripper rubber seals with either or both passive or active seals. Seal 14 seals the annulus AB between the drill pipe tubular 12 and the UMDC housing (24, 24A, 24B, 24C, 24D). Flange 1 of lower section 2 of UMDC housing 24A may rest on marine housing 80, and be sealed with radial seal 82. It is contemplated that flange 1 may overhang the outside diameter of marine housing 80. UMDC housing 24A may be positioned with marine housing 80 with a conventional annular elastomer packer seal 43 of the BOP marine diverter, such as described in U.S. Pat. No. 4,626,135, which annular elastomer packer seal 43 is moved by annular pistons P. Annular seal 43 compresses on cylindrical insert 88 and seals the annular space A between cylindrical insert 88 and marine diverter housing 80. Although an annular elastomer packer seal 43 is shown, other conventional passive and active seal configurations, some of which are discussed below, are contemplated. UMDC housing 24A of FIG. 5 may be positioned with marine housing 80 using the embodiments of a conventional inflatable annular elastomer seal (42, 64) shown in FIGS. 6-7, or the embodiment of a conventional annular elastomer seal 120 shown in FIG. 5A. If an elastomer seal, such as seal 43 is used, UMDC housing 24A may be configured as shown in FIGS. 2, 5, and 6 of U.S. Pat. No. 6,470,975 B1. It is also contemplated that that a mechanical packer seal may be used.

Outlets (39, 40) in marine diverter housing 80 allow return flow of drilling fluid when the pistons P are raised as shown in FIG. 5. An elastomer layer or coating 35, as described in detail above, may be laid or placed radially on the outer surface of cylindrical insert 88, preferably where it has contact with seal 43. Holding member 90 is threadably connected to cylindrical insert 88. Internal diameter 101 of cylindrical insert 88 and/or holding member 90 varies in size depending on the inside diameter of marine housing 80. It is contemplated that the internal diameter may be from eleven inches to thirty-six inches (27.9 to 91.4 cm), with twenty-five inches (63.5 cm) being a typical internal diameter. However, other diameters and sizes are contemplated as well as different configurations referenced above.

Figure 5A:
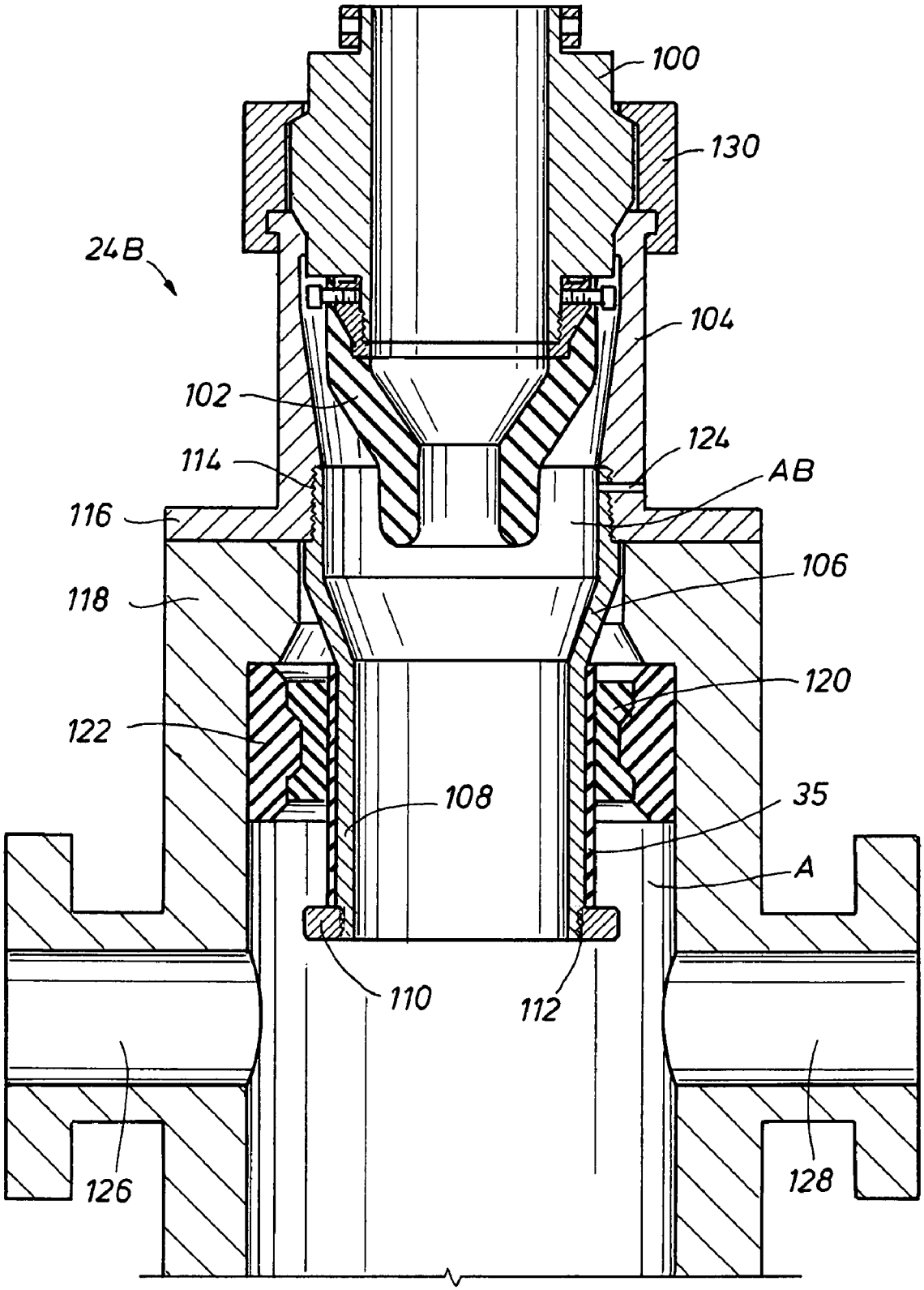
FIG. 5A is a cut away section elevational view of a RCD clamped to a UMDC housing of the present invention, which UMDC has been positioned in an exemplary embodiment of a marine diverter cylindrical housing with a conventional active elastomer packer seal therein.

FIG. 5A shows a UMDC housing 24B of the present invention, which has upper section 104 and lower section 106. Upper housing section 104 includes circumferential flange 116, which may be positioned on marine diverter housing 118, and, if desired, sealed with a radial seal. Lower housing section 106 includes cylindrical insert 108 and holding member 110. Upper housing section 104 is threadably connected with lower section 106 at threaded connection 114, which allows lower section 106 sized for the desired marine housing 118 and upper section 104 sized for the desired RCD 100 to be connected. Holding member or upset ring 110 is threadably connected with cylindrical insert 108 at threaded joint 112. Threaded connection 112 allows different outside diameter holding member 110 to be positioned on the same cylindrical insert 108 and allows layer 35 to slide onto insert 108. It is contemplated that threaded connection 112 may use reverse (left hand) threads that preferably tighten in the direction of rotation of drill string tubulars for drilling. It is also contemplated that threaded connection 114 may use conventional right hand threads. It is also contemplated that there may be no threaded connections (112, 114) so that upper section 104 is integral with lower section 106. One or more anti-rotation pins 124 may be placed through aligned openings in threaded connection 114 after upper section 104 and lower section 106 are threadably connected to insure that the connection 114 does not become loosened, such as, discussed above, when the drill string is lifted off bottom.

Remaining with FIG. 5A, RCD 100 may be clamped with clamp 130 to upper section 104. Clamp 130 may be manual, hydraulic, pneumatic, mechanical, or some other form of remotely operated clamping means. RCD 100 preferably has a lower stripper rubber seal 102. It is contemplated that lower seal 102 may have an ⅞ inch (2.2 cm) interference fit around any inserted drill string tubular to initially seal to 2000 psi pressure. However, other sizes, interference fits, and pressures are contemplated as well. Seal 102 seals the annulus AB between the drill pipe tubular (not shown) and the UMDC housing (24, 24A, 24B, 24C, 24D). It should be understood that different types of RCDs (7, 10, 100) may be positioned in the UMDC housing 24B, including RCDs (7, 10, 100) with dual stripper rubber seals with either or both passive or active seals. UMDC housing 24B may be positioned with marine housing 118 with a conventional active annular elastomer seal 120 activated by assembly 122, such as proposed in Pub. No. US 2006/0144622 A1 and shown in FIG. 2A of the '622 publication. It is contemplated that assembly 122 may be hydraulic, pneumatic, mechanical, manual, or some other form of remotely operated means. Upon activation, annular seal 120 compresses on cylindrical insert 108 and seals the annular space A between cylindrical insert 108 and marine diverter housing 118. Although an active annular elastomer seal 120 is shown, other passive and active seal configurations, some of which are discussed herein, are contemplated. If an elastomer seal, such as seal 43 in FIG. 4 is used, UMDC housing 24B may be configured as shown in FIGS. 2, 5, and 6 of U.S. Pat. No. 6,470,975 B1. It is also contemplated that that a mechanical packer seal may be used.

Outlets (126, 128) in marine diverter housing 118 allow return flow of drilling fluid. It is contemplated that the inside diameters of outlets (126, 128) may be 16 to 20 inches (40.6 to 50.8 cm). However, other opening sizes are contemplated as well. It is contemplated that one outlet, such as outlet 128, may lead to a remotely operated valve and a dump line, which may go overboard and/or into the sea. The other outlet, such as outlet 126, may lead to another valve and line, which may go to the rig's gas buster and/or mud pits. However, other valves and lines are contemplated as well. The driller or operator may decide which valve is to be open when he closes seal 120 upon an inserted drill string tubular. It is contemplated that there may be safeguards to prevent both valves from being closed at the same time. It is also contemplated that most often it would be the line to the gas buster that would be open when seal 120 is closed, most commonly to circulate out small kicks, or to safely divert gas that has disassociated from the mud and cuttings in the riser system. It is further contemplated that the above described operations may be used with any embodiment of UMDC housing (24, 24A, 24B, 24C, 24D). The inserted UMDC housing (24, 24A, 24B, 24C, 24D) with RCD (7, 10, 100) allows continuous drilling while circulating out gas that does not amount to a significant well control problem. In potentially more serious well control scenarios and/or where the rig's gas buster may not be able to handle the flow rate or pressures, it is contemplated that the returns may be also directed to the diverter's dump line.

FIG. 6 shows a UMDC housing 24C of the present invention, which has upper section 26 and lower section 50. Lower housing section 50 includes circumferential flange 58 and cylindrical insert 52. Upper housing section 26 is threadably connected with lower section 50 at threaded connection 30, which allows lower section 50 to be sized for the desired marine housing 60 and the upper section to be sized for the desired RCD 100. FIG. 6 shows a conventional annular elastomer packer seal 43 and a conventional inflatable annular elastomer seal 42 at different compression stages on the right and left side of the vertical axis. On the right side of the vertical axis, UMDC housing 24C is positioned with conventional inflatable seal 42 that has been inflated to a desired pressure. Elastomer packer seal 43 is directly engaged with inflatable seal 42, although annular pistons P are in the lowered position.

On the left side of the vertical axis, elastomer packer seal 43 has further compressed inflatable annular elastomer seal 42, as annular pistons P are raised further. Inflatable annular elastomer seal 42 has been inflated to a predetermined pressure. Elastomer packer seal 43 and inflatable seal 42 seal the annular space A between cylindrical insert 52 and the marine diverter housing 60. As can now be understood, it is contemplated that either the inflatable annular elastomer seal 42 or an annular elastomer packer seal 43, or a combination of the two, could position UMDC housing 24C and seal the annular space A, as is shown in the embodiment in FIG. 6. Inflatable seal 42 could be pressurized at a predetermined pressure in combination with other active and passive seals. Inflatable annular elastomer seal 42 is preferably hydraulically or pneumatically remotely pressurized through valve port 56. It is contemplated that the use of inflatable annular elastomer seal 42 and annular elastomer packer seal 43 in combination as shown in FIG. 6 can be optimized for maximum efficiency. It is also contemplated that inflatable annular seal 42 may be reinforced with steel, plastic, or some other rigid material.

Turning to FIG. 7, another UMDC housing 24D with upper section 26 and lower section 66 is positioned with a marine housing 70 with a single conventional inflatable annular elastomer seal 64. Lower housing section 66 includes circumferential flange 76 and cylindrical insert 72. Inflatable seal 64 is inflated to a predetermined pressure to seal the annular space A between the cylindrical insert 72 and the marine diverter housing 70. Although a single inflatable annular seal 64 is shown, a plurality of active seals are contemplated as well. Inflatable seal 64 may be hydraulically or pneumatically remotely pressurized through an active valve port 68. Also, a sensor 68A could be used to remotely monitor the pressure in seal 64. It is contemplated that sensor 68A could be electrical, mechanical, or hydraulic. It is contemplated that any such inflatable annular elastomer seal (42, 64) would return to its uninflated shape after the pressure was released.

It is contemplated that the outer surface of cylindrical metal insert (34, 52, 72, 88, 108), particularly where it has contact with annular seal (42, 43, 64, 120), may be profiled, shaped, or molded to enhance the seal and grip therebetween. For example, the outer surface of the metal cylindrical insert (34, 52, 72, 88, 108) may be formed uneven, such as rough, knurled, or grooved. Further, the outer surface of cylindrical insert (34, 52, 72, 88, 108) may be formed to correspond to the surface of the annular seal (42, 43, 64, 120) upon which it would be contacting. It is also contemplated that a layer 35 of elastomer or a different material could also be profiled, shaped, or molded to correspond to either the outer surface of the cylindrical metal insert (34, 52, 72, 88, 108) or annular seal (42, 43, 64, 120), or both, to enhance the seal and grip. Further, it is contemplated that the surface of annular seal (42, 43, 64, 120) may be formed uneven, such as rough, knurled, or grooved, to enhance the seal and grip.

Figure 8:
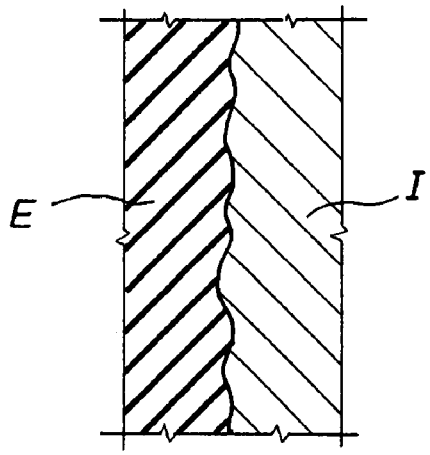
FIG. 8 is an enlarged section elevation view of the interface of an elastomer seal with the uneven surface of the UMDC metal housing of the present invention.
Figure 9:
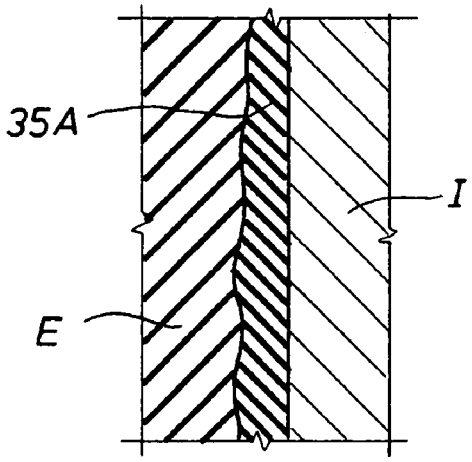
FIG. 9 is an enlarged section elevation view of an elastomer layer between the elastomer seal and an even metal surface of the UMDC housing.
Figure 10:
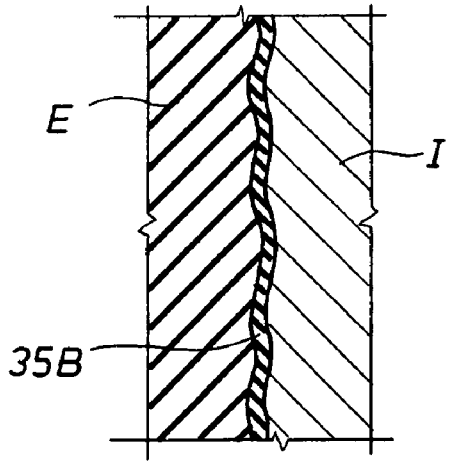
FIG. 10 is an enlarged section elevation view of an elastomer layer between the elastomer seal and an uneven metal surface of the UMDC housing.

Turning to FIGS. 8-10, different embodiments of an cylindrical insert, generally indicated as I, that includes cylindrical inserts 34, 52, 72, 88, and 108; and the annular seal E, that includes annular seals 42, 43, 64, and 120, are illustrated. It should be understood that the outer surface of the cylindrical insert I may be profiled to enhance the seal and grip depending on the configuration of the annular seal E. For example, FIG. 8 shows the surface of the cylindrical metal insert I has been grooved to enhance the seal and grip with seal E. FIG. 9 shows another embodiment where the surface of the cylindrical metal insert I has not been profiled, but layer 35A has been profiled with grooves to enhance the seal and grip with seal E. FIG. 10 shows yet another embodiment in which the cylindrical metal insert I has been profiled with grooves, so that an even consistent layer 35B has a resulting groove profile. It should be understood that the profiling of the surfaces of the cylindrical insert I and layer (35, 35A, 35B) may be fabricated in any combination. It is contemplated that layer (35, 35A, 35B) may be gritty or roughened to further enhance its gripping capability.

It should now be understood that the UMDC housing (24, 24A, 24B, 24C, 24D) of the present invention can be received in a plurality of different marine housings (38, 60, 70, 80, 118). It should be understood that even though one UMDC housing (24, 24A, 24B, 24C, 24D) is shown in each of FIGS. 4-7, the upper sections (3, 26, 104) and lower sections (2, 28, 50, 66, 106) of the UMDC housings (24, 24A, 24B, 24C, 24D) are interchangeable as long as the assembled housing includes connection means for connecting an RCD (7, 10, 100), a circumferential flange (1, 32, 58, 76, 116), a cylindrical insert (34, 52, 72, 88, 108), and a holding member (37, 90, 110). It should also be understood that the UMDC housing (24, 24A, 24B, 24C, 24D) of the present invention can accommodate different types and sizes of RCDs (7, 10, 100), including those with a single stripper rubber seal, and dual stripper rubber seals with either or both active seals and/or passive seals. It should also be understood that even though an RCD (10, 100) is shown clamped with the UMDC housing (24, 24B, 24C, 24D) of the present invention in FIGS. 4, 5A, 6, and 7, and an RCD 7 is shown latched with the UMDC housing 24A of the present invention in FIG. 5, other oilfield equipment is contemplated being clamped and/or latched therein, such as a non-rotating stripper, non-rotating casing stripper, drilling nipple, test plug, wireline lubricator, or snubbing adaptor. Also, other attachment methods as are known in the art are contemplated as well.

A running tool may be used to install and remove the UMDC housing (24, 24A, 24B, 24C, 24D) and attached RCD (7, 10, 100) into and out of the marine housing (38, 60, 70, 80, 118) through well center FC, as shown in FIG. 1, and/or C, as shown in FIG. 2. A radial latching device, such as a C-ring, retainer, or plurality of lugs or dogs, on the lower end of the running tool mates with a radial shoulder of the RCD (7, 10, 100).

As can now be understood, the UMDC housing (24, 24A, 24B, 24C, 24D) of the present invention with an attached RCD (7, 10, 100) can be used to convert any brand, size and/or shape of marine diverter (FD, D, 38, 60, 70, 80, 118) into a rotating diverter to enable a closed and pressurized mud-return system, which results in enhanced health, safety, and environmental performance. Nothing from the marine diverter (FD, D, 38, 60, 70, 80, 118) has to be removed, including the top of the marine diverter. The UMDC housing (24, 24A, 24B, 24C, 24D) with an attached RCD (7, 10, 100) allows many drilling operations to be conducted with a closed system without damaging the closed annular seal (42, 43, 64, 120). The UMDC housing (24, 24A, 24B, 24C, 24D) and attached RCD (7, 10, 100) may be installed relatively quickly without modifications to the marine diverter, and enables a closed and pressurized mud-return system. The outside diameter of the circumferential flange (1, 32, 58, 76, 116) of the UMDC housing (24, 24A, 24B, 24C, 24D) is preferably smaller than the typical 49½ inch (1.26 m) inside diameter of an offshore rig rotary table. Because the cylindrical insert (34, 52, 72, 88, 108) spans the length of the seals (42, 43, 64, 120), a tubular 12 may be lowered and rotated without damaging the marine diverter sealing elements, such as seals (42, 43, 64, 120), thereby saving time, money, and increasing operational safety.

RCD (7, 10, 100) bearing assembly designs may accommodate a wide range of tubular sizes. It is contemplated that the pressure rating of the RCD (7, 10, 100) attached with the UMDC housing (24, 24A, 24B, 24C, 24D) may be equal to or greater than that of the marine diverter (FD, D, 38, 60, 70, 80, 118). However, other pressure ratings are contemplated as well. The UMDC housing (24, 24A, 24B, 24C, 24D) with attached RCD (7, 10, 100) may be lowered into an open marine diverter (FD, D, 38, 60, 70, 80, 118) without removing seal (42, 43, 64, 120). The installation saves time, improves safety, and preserves environmental integrity. The UMDC housing (24, 24A, 24B, 24C, 24D) of the present invention may be used, among other applications, in (1) offshore managed pressure drilling or underbalanced drilling operations from a fixed platform or a jack-up rig, (2) drilling operations with shallow gas hazards, (3) drilling operations in which it is beneficial to conduct pipe or other tubular movement with a closed diverter system, and (4) drilling operations with simultaneous circulation of drilled cuttings gas.

Method of Use

A conventional annular BOP marine diverter (FD, D, 38, 60, 70, 80, 118), including, but not limited to, the diverters (FD, D) as configured in FIGS. 1 and 2, can be converted to a rotating marine diverter, as shown in FIGS. 4-7, using the UMDC housing (24, 24A, 24B, 24C, 24D) of the present invention. The top of the conventional annular BOP housing (38, 60, 70, 80, 118) does not have to be removed for the method of the present invention, although it can be if desired. The conventional annular seal (42, 43, 120) may be left in place as in FIGS. 4, 5, 5A, and 6. On the drilling rig, the upper section (3, 26, 104) of the UMDC housing (24, 24A, 24B, 24C, 24D) is threadably connected with the desired lower section (2, 28, 50, 66, 106) appropriate for the conventional marine diverter housing (38, 60, 70, 80, 118) as long as the assembled housing includes connection means for connecting an RCD (7, 10, 100), a circumferential flange (1, 32, 58, 76, 116), a cylindrical insert (34, 52, 72, 88, 108), and a holding member (37, 90, 110). The outer surface of the cylindrical insert (34, 52, 72, 88, 108) of the lower housing section (2, 28, 50, 66, 106) may have an elastomer layer (35, 35A, 35B). The insert (34, 52, 72, 88, 108) and/or layer (35, 35A, 35B) may be profiled as desired to enhance the seal and grip.

On the drilling rig, RCD (7, 10, 100) may be clamped with clamp (16, 130) or latched with latching assembly 6 to the desired UMDC housing (24, 24A, 24B, 24C, 24D). The RCD (7, 10, 100) and UMDC housing (24, 24A, 24B, 24C, 24D) may be lowered through the well center (FC, C) with a hydraulic running tool or upon a tool joint as previously described, and positioned with the conventional annular BOP housing (38, 60, 70, 80, 118). When the flange (1, 32, 58, 76, 116) of the UMDC housing (24, 24A, 24B, 24C, 24D) engages the top of the conventional annular BOP housing (38, 60, 70, 80, 118), the running tool is disengaged from the RCD (7, 10, 100)/UMDC housing (24, 24A, 24B, 24C, 24D). If an inflatable seal (42, 64) is used, it is inflated to a predetermined pressure to hold the UMDC housing (24, 24A, 24B, 24C, 24D) with the conventional annular BOP housing (38, 60, 70, 80, 118). If the annular elastomer packer seal 43 is left in place, it may be moved upwardly and inwardly with annular pistons P to hold the UMDC housing (24, 24A, 24B, 24C, 24D). As has been previously described with FIG. 6, when a combination annular elastomer packer seal 43 and inflatable seal (42, 64) are used, the inflatable seal (42, 64) can be inflated to a predetermined pressure in different combinations of moving the annular pistons P upwardly to move the annular elastomer packer seal 43 upward and inward to hold the UMDC housing (24, 24A, 24B, 24C, 24D). The desired annular seal (42, 43, 64, 102) seals the annulus A between the UMDC housing (24, 24A, 24B, 24C, 24D) and the marine housing (38, 60, 70, 80, 118).

After the UMDC housing (24, 24A, 24B, 24C, 24D) is secured, drilling may begin. The tubular 12 can be run through well center (FC, C) and then through the RCD (7, 10, 100) for drilling or other operations. The RCD 10 upper seal and/or lower (14, 102) stripper rubber seal rotate with the tubular and allow the tubular to slide through, and seal the annulus AB between the tubular and UMDC housing (24, 24A, 24B, 24C, 24D) so that drilling fluid returns (shown with arrows in FIG. 4) will be directed through the outlets (39, 40, 126, 128). Drilling fluid returns may be diverted as described above by closing annular seals (42, 43, 64, 120). When drilling has stopped, RCD (7, 10, 100) may be manually or remotely unclamped and/or unlatched and raised a sufficient distance out of the UMDC housing (24, 24A, 24B, 24C, 24D) so that the lower stripper rubber seal (14, 102) may be checked for wear or replaced.

The foregoing disclosure and description of the invention are illustrative and explanatory thereof, and various changes in the details of the illustrated apparatus and system, and the construction and the method of operation may be made without departing from the spirit of the invention.

I claim:

1. An apparatus for use with a diverter having a seal and used in the oilfield drilling industry, comprising:

a housing having an outwardly radially extending flange and a cylindrical insert extending below said flange, said housing flange and said housing cylindrical insert being connected and movable together relative to the diverter seal, said seal moving between a holding position wherein said diverter seal holds said housing flange relative to the diverter and an open position wherein said housing is removable from the diverter while the diverter seal remains in the diverter, a rotating control device removably attached to said housing, and said flange sized to engage the diverter to block movement of said housing relative to the diverter seal.

2. The apparatus of claim 1, wherein said housing having an upper section and a lower section, said outwardly radially extending flange and said cylindrical insert are disposed with said lower section, and said rotating control device removably attached with said upper section.

3. The apparatus of claim 1, wherein said housing having an upper section and a lower section, said cylindrical insert extending below said upper section, said outwardly radially extending flange disposed at one end of said upper section and said rotating control device disposed at the other end of said upper section.

4. The apparatus of claim 1, wherein said rotating control device is clamped to said housing.

5. The apparatus of claim 1, wherein said rotating control device is latched to said housing.

6. The apparatus of claim 2, wherein said upper section is threadably connected to said lower section.

7. The apparatus of claim 3, wherein said upper section is threadably connected to said lower section.

8. The apparatus of claim 1, further comprising:

a holding member extending radially outwardly from said cylindrical insert.

9. The apparatus of claim 8, wherein said holding member is threadably connected to said housing.

10. The apparatus of claim 8, wherein said holding member is threadably connected to said housing using a left-hand thread.

11. The apparatus of claim 1, further comprising a material covering at least a portion of said cylindrical insert.

12. The apparatus of claim 11, wherein said material is an elastomer.

13. The apparatus of claim 11, wherein said material is sprayed on said insert.

14. A method of converting a diverter used above a riser in the oilfield drilling industry between an open mud-return system and a closed and pressurized mud-return system, comprising the steps of:

moving a housing having a cylindrical insert at one end and a rotating control device at another end through a drill floor opening, and blocking further movement of said housing in a first direction upon insertion of a portion of said housing in the diverter above said riser while a portion of said rotating control device extends above said riser and said housing.

15. The method of claim 14, further comprising the steps of:

lowering a drill pipe from said drill floor and through said housing, and rotating said drill pipe while managing pressure with said diverter.

16. The method of claim 14, further comprising the step of:

protecting said diverter from said drill pipe after the step of lowering said drill pipe.

17. The method of claim 16, further comprising the step of:

opening a side outlet of the diverter.

18. The method of claim 14, wherein the step of blocking further movement of said housing is performed without removing any component from said diverter.

19. The method of claim 14, further comprising the step of:

allowing drilling of a well to continue while fluid is circulated out of said well.

20. The method of claim 14, wherein the pressure rating of the rotating control device is at least equal to the pressure rating of said diverter.

21. An apparatus for use with a diverter having a seal movable between a holding position and an open position, comprising:

a housing having an outwardly radially extending flange and a cylindrical insert, said housing flange being connected with said housing cylindrical insert, and a rotating control device removably latched to said housing, wherein said flange is sized for engaging the diverter to block movement of said housing relative to the diverter seal, and wherein said housing cylindrical insert is sealable with said diverter seal and said rotating control device is configured for being removed from said housing when said diverter seal is in said holding position.

22. The apparatus of claim 21, wherein said housing cylindrical insert extending below said housing flange with a holding member extending radially outwardly from said housing cylindrical insert and said holding member is threadably attached to said housing.

23. An apparatus for use with a diverter having a seal movable between a holding position and an open position and disposed above a marine riser, comprising:

a housing having an outwardly radially extending flange and a cylindrical insert extending below said flange, wherein said cylindrical insert is sealable with said diverter seal when said diverter seal is in the holding position, a holding member extending radially outwardly from said cylindrical insert, an elastomer covering a portion of said cylindrical insert, a rotating control device removably attached to said housing, and said flange sized to block movement of said housing relative to the diverter seal.

24. The apparatus of claim 23, wherein said elastomer is a sleeve of elastomer that is slidable about said cylindrical insert upon removing said holding member.

25. An apparatus for use with a diverter for moving an annular packer seal between a holding position and an open position and used in the oilfield drilling industry, comprising:

a housing configured for removably positioning a rotating control device with said diverter when said annular packer seal is in the holding position, and a rotating control device removably attached to said housing and said rotating control device is configured for being removed from said housing independent of rotation of said rotating control device when said annular packer seal is in said holding position.

26. The apparatus of claim 25 wherein said diverter having a seal and said housing having an outwardly radially extending flange connected with a cylindrical insert extending below said flange, said housing flange and said housing cylindrical insert movable together relative to the diverter seal, said seal moving between said holding position wherein said diverter seal holds said housing flange relative to the diverter and said open position wherein said housing is removable from the diverter.

27. A method of converting a diverter having a seal and used in the oilfield drilling industry for a pressurized mud-return system using a stripper rubber, comprising the steps of:

moving a housing having a cylindrical insert connected with a flange below a drill floor, blocking further movement of said housing in a first direction upon insertion of said housing cylindrical insert in the diverter, holding said housing relative to said diverter using the diverter seal, and during the step of holding, removing the stripper rubber from said housing.

28. The method of claim 27, wherein during the step of holding, said diverter seal holds said housing flange with said diverter by engaging said housing cylindrical insert.

* * * * *